US011371322B2

(12) United States Patent
Steele

(10) Patent No.: US 11,371,322 B2
(45) Date of Patent: Jun. 28, 2022

(54) ENERGY TRANSFER MECHANISM FOR A JUNCTION ASSEMBLY TO COMMUNICATE WITH A LATERAL COMPLETION ASSEMBLY

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/616,551

(22) PCT Filed: Sep. 19, 2017

(86) PCT No.: PCT/US2017/052165
§ 371 (c)(1),
(2) Date: Nov. 25, 2019

(87) PCT Pub. No.: WO2019/059885
PCT Pub. Date: Mar. 28, 2019

(65) Prior Publication Data

US 2021/0140276 A1 May 13, 2021

(51) Int. Cl.
*E21B 41/00* (2006.01)
*E21B 47/13* (2012.01)
(Continued)

(52) U.S. Cl.
CPC ..... *E21B 41/0035* (2013.01); *E21B 17/0283* (2020.05); *E21B 41/0042* (2013.01); *E21B 43/14* (2013.01); *E21B 47/13* (2020.05)

(58) Field of Classification Search
CPC .. E21B 41/0035; E21B 17/0283; E21B 43/14; E21B 17/028; E21B 41/0042; E21B 47/13
See application file for complete search history.

(56) References Cited

U.S. PATENT DOCUMENTS 2,618,339 A * 11/1952 Glover ..... E21B 43/14 166/114
5,467,826 A 11/1995 Miller
(Continued)

FOREIGN PATENT DOCUMENTS

WO WO 2016/000068 A1 1/2016
WO WO 2016/007165 A1 1/2016

OTHER PUBLICATIONS

Dyer et al., "New Intelligent Completion System Enables Compartment-Level Control in Multilateral Wells," *Journal of Petroleum Technology*, vol. 68, Issue 9, Aug. 15, 2016, https://pubs.spe.org/en/jpt/jpt-article-detail/?art=1385.
(Continued)

*Primary Examiner* — Nicole Coy
(74) *Attorney, Agent, or Firm* — Haynes and Boone, LLP

(57) ABSTRACT

A system and method to controlling fluid flow to/from multiple intervals in a lateral wellbore. The system and method can include a unitary multibranch inflow control (MIC) junction assembly (a primary passageway through a primary leg and a lateral passageway through a lateral leg) installed at an intersection of main and lateral wellbores. An upper energy transfer mechanism (ETM) can be mounted along the primary passageway, and control lines 100 can provide communication between the upper ETM 214 and lower completion assembly equipment. A lower ETM can be mounted along the lateral passageway, with the upper ETM in communication with the lower ETM via the control lines. A tubing string can be extended through the primary passageway to access lower completion assembly equipment. The upper ETM can communicate with a tubing string ETM to receive/transmit control, data, and/or power signals from/to lower completion equipment in the lateral wellbores.

23 Claims, 23 Drawing Sheets

(51) Int. Cl.
*E21B 43/14* (2006.01)
*E21B 17/02* (2006.01)

(56) References Cited

U.S. PATENT DOCUMENTS

| | | | | |
|---|---|---|---|---|
| 5,927,401 | A | 7/1999 | Morris et al. | |
| 5,944,107 | A | 8/1999 | Ohmer | |
| 6,089,320 | A | 7/2000 | LaGrange | |
| 6,209,648 | B1 | 4/2001 | Ohmer et al. | |
| 6,568,469 | B2 * | 5/2003 | Ohmer | E21B 47/12 166/50 |
| 6,729,410 | B2 | 5/2004 | Steele | |
| 6,907,930 | B2 | 6/2005 | Cavender et al. | |
| 7,299,878 | B2 | 11/2007 | Steele | |
| 7,387,165 | B2 | 6/2008 | Lopez de Cardenas et al. | |
| 7,900,705 | B2 | 3/2011 | Patel | |
| 8,074,743 | B2 * | 12/2011 | Patel | E21B 47/12 175/61 |
| 8,397,819 | B2 | 3/2013 | Tunget | |
| 8,701,775 | B2 | 4/2014 | Steele | |
| 8,826,991 | B2 | 9/2014 | Steele et al. | |
| 9,200,482 | B2 | 12/2015 | Steele | |
| 9,303,490 | B2 | 4/2016 | Pendleton | |
| 9,366,129 | B2 | 6/2016 | Al-Yami et al. | |
| 10,018,019 | B2 * | 7/2018 | Steele | E21B 33/12 |
| 10,087,718 | B2 * | 10/2018 | Steele | E21B 33/12 |
| 10,344,570 | B2 | 7/2019 | Steele | |
| 10,472,933 | B2 | 11/2019 | Steele | |
| 2001/0035288 | A1 | 11/2001 | Brockman et al. | |
| 2003/0062717 | A1 | 4/2003 | Thomas et al. | |
| 2004/0182579 | A1 * | 9/2004 | Steele | E21B 43/105 166/313 |
| 2005/0115713 | A1 | 6/2005 | Restarick et al. | |
| 2006/0289156 | A1 | 12/2006 | Murray | |
| 2007/0089875 | A1 | 4/2007 | Steele et al. | |
| 2011/0011580 | A1 | 1/2011 | Clark et al. | |
| 2012/0067567 | A1 | 3/2012 | Rytlewski et al. | |
| 2013/0068453 | A1 | 3/2013 | Al-Ajaji et al. | |
| 2015/0176378 | A1 | 6/2015 | Ramey, Jr. et al. | |
| 2016/0145956 | A1 | 5/2016 | Dahl et al. | |
| 2016/0341010 | A1 | 11/2016 | Hepburn et al. | |
| 2017/0067321 | A1 | 3/2017 | Parlin et al. | |
| 2019/0040715 | A1 * | 2/2019 | Provost | E21B 43/14 |

OTHER PUBLICATIONS

International Search Report and The Written Opinion of the International Search Authority, or the Declaration, Jun. 18, 2018, PCT/US2017/052165, 17 pages, ISA/KR.

Manara Production and Reservoir Management System, https://www.slb.com/completions/well-completions/intelligent-completions/intelligent-completion-systems/manara-production-and-reservoir-management.

SmartWell@ Hydraulic Disconnect Tool, https://www.halliburton.com/en-US/ps/well-dynamics/well-completions/intelligent-completions/system-accessories/smartwell-hydraulic-disconnect-tool.html.

* cited by examiner

ENERGY TRANSFER MECHANISM FOR A JUNCTION ASSEMBLY TO COMMUNICATE WITH A LATERAL COMPLETION ASSEMBLY

PRIORITY

The present application is a U.S. National Stage patent application of International Patent Application No. PCT/US2017/052165, filed on Sep. 19, 2017, the benefit of which is claimed and the disclosure of which is incorporated herein by reference in its entirety.

TECHNICAL FIELD

The present disclosure relates generally to completing wellbores in the oil and gas industry and, more particularly, to a multilateral junction that permits electrical power and communications signals to be established in both a lateral wellbore and a main wellbore utilizing a unitary multilateral junction.

BACKGROUND

In the production of hydrocarbons, it is common to drill one or more secondary wellbores (alternately referred to as lateral or branch wellbores) from a primary wellbore (alternately referred to as parent or main wellbores). The primary and secondary wellbores, collectively referred to as a multilateral wellbore, may be drilled, and one or more of the primary and secondary wellbores may be cased and perforated using a drilling rig. Thereafter, once a multilateral wellbore is drilled and completed, production equipment such as production casing, packers and screens can be installed in the wellbore, then the drilling rig may be removed and the primary and secondary wellbores are allowed to produce hydrocarbons.

It is often desirable during the installation of the production equipment to include various operational devices such as permanent sensors, flow control valves, digital infrastructure, optical fiber solutions, Intelligent Inflow Control Devices (ICD's), seismic sensors, vibration inducers and sensors and the like that can be monitored and controlled remotely during the life of the producing reservoir. Such equipment is often referred to as intelligent well completion equipment and permits production to be optimized by collecting, transmitting, and analyzing completion, production, and reservoir data; allowing remote selective zonal control and ultimately maximizing reservoir efficiency. Typically, communication signals and electrical power between the surface and the intelligent well completion equipment are via cables extending from the surface. These cables may extend along the interior of a tubing string or the exterior of a tubing string or may be integrally formed within the tubing string walls. However, it will be appreciated that to maintain the integrity of the well, it is desirable for a cable not to breach or cross over pressure barriers formed by the various tubing, casing and components (such as packers, collars, hangers, subs and the like) within the well. For example, it is generally undesirable for a cable to pass between an interior and exterior of a tubing string since the aperture or passage through which the cable would pass could represent a breach of the pressure barrier formed between the interior and exterior of the tubing.

Moreover, because of the construction of the well, it may be difficult to deploy control cables from the surface to certain locations within the well. The presence of junctions between various tubing, casings, and components such as packers, collars, hangers, subs and the like, within the wellbore, particularly when separately installed, may limit the ability to extend cables to certain portions of the wellbore. This is particularly true in the case of lateral wellbores since completion equipment in lateral wellbores is installed separately from installation of completion equipment in the main wellbore. In this regard, it becomes difficult to extend cabling through a junction at the intersection of two wellbores, such as the main and lateral wellbores, because of the installation of equipment into more than one wellbore requires separate trips since the equipment cannot be installed at the same time unless the equipment is small enough to fit side-by-side in the main bore while tripping in the hole. Secondly, if there is more than one wellbore, the equipment would have to be spaced out precisely so that each segment of lateral equipment would be able to exit into its own lateral wellbore at the precise time the other equipment was exiting into their respective laterals, while at the same time maintaining connectivity with other locations in the wellbore.

Therefore, it will be readily appreciated that improvements in the arts of controlling intelligent well completion equipment in a multilateral wellbore are continually needed.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1A:
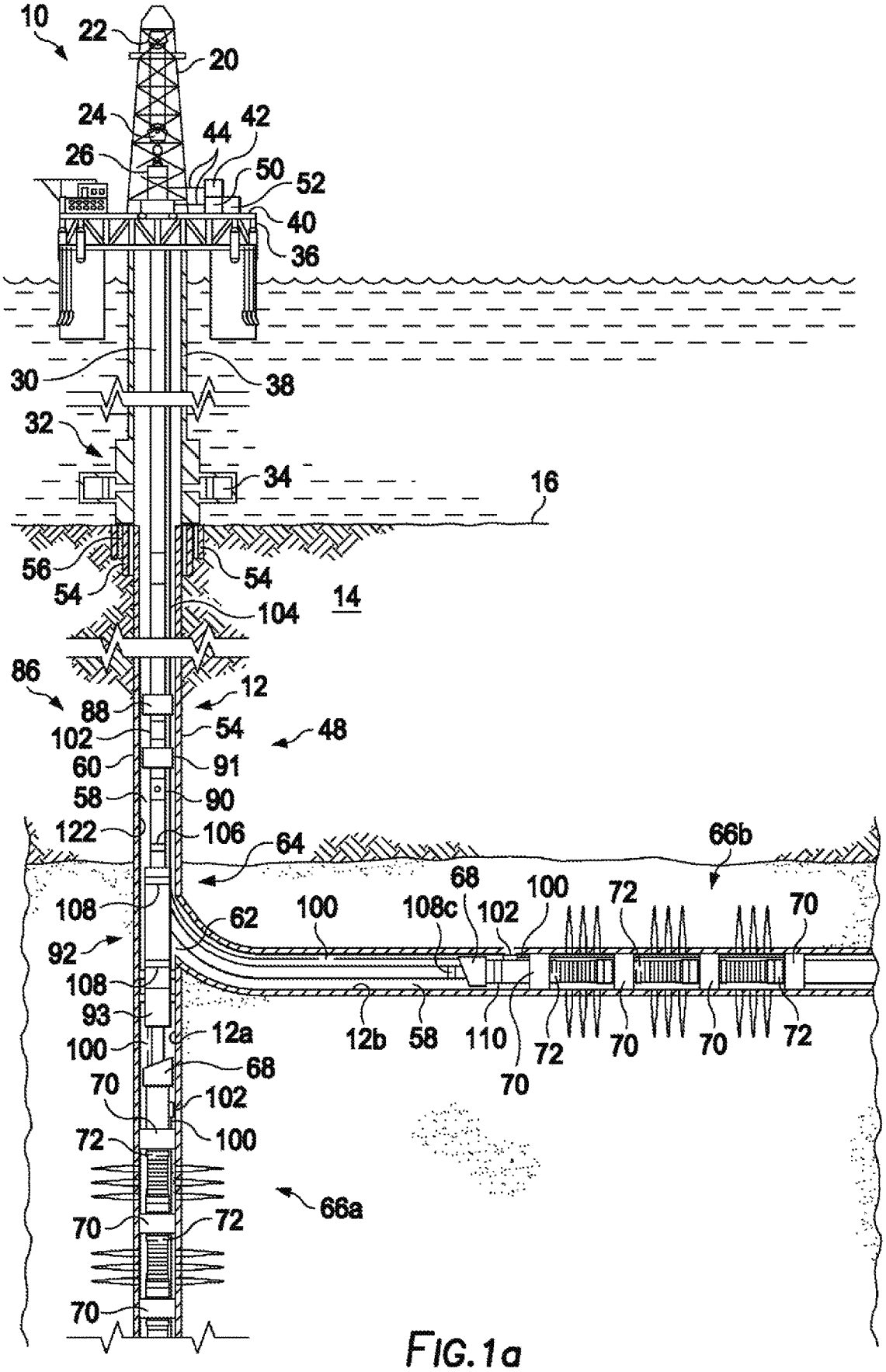
FIG. 1*a* is a representative partial cross-sectional view of an offshore well completion system having a unitary junction assembly installed at the intersection of a main wellbore and a lateral wellbore, according to one or more example embodiments.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict a horizontal wellbore or a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a figure may depict an offshore operation, it should be understood by those skilled in the art that the method and/or system according to the present disclosure is equally well suited for use in onshore operations and vice-versa. Further, unless otherwise noted, even though a figure may depict a cased hole, it should be understood by those skilled in the art that the method and/or system according to the present disclosure is equally well suited for use in partially cased and/or open hole operations.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. It should also be understood that, as used herein, "first," "second," and "third," are assigned arbitrarily and are merely intended to differentiate between two or more objects, etc., as the case may be, and does not indicate any sequence. Furthermore, it is to be understood that the mere use of the word "first" does not require that there be any "second," and the mere use of the word "second" does not require that there be any "first" or "third," etc.

The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

Generally, this disclosure provides a system and method that can include a unitary multibranch inflow control (MIC) junction assembly having a conduit with a first aperture at an upper end of the conduit, and second and third apertures at a lower end of the conduit; a primary passageway can be formed by the conduit and extending from the first aperture to the second aperture with a conduit junction defined along the conduit between the first and second apertures. The primary passageway can include an upper portion and a lower portion with the upper portion extending from the first aperture to the conduit junction, and the lower portion extending from the conduit junction to the second aperture; a lateral passageway can be formed by the conduit and extend from the conduit junction to the third aperture; an upper energy transfer mechanism (ETM) can be mounted along the upper portion of the primary passageway and proximate the first aperture; control lines 100 can provide communication between the upper ETM 214 and lower completion assembly equipment. A lower ETM can be mounted along the lateral passageway, with the upper ETM in communication with the lower ETM via the control lines; and the primary passageway can be configured to receive a first tubing string that extends therethrough.

Figure 1B:
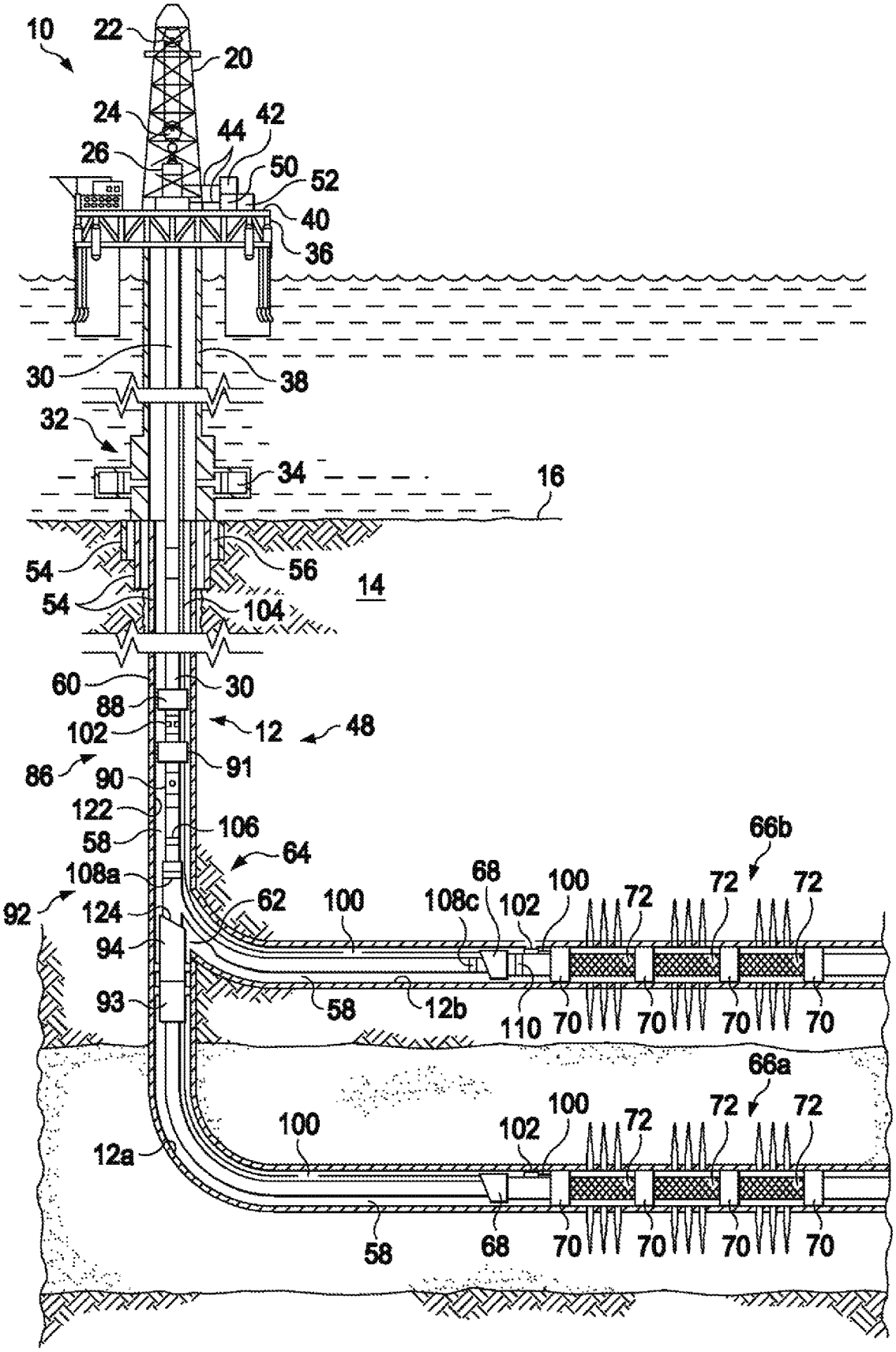
FIG. 1*b* is another representative partial cross-sectional view of an offshore well completion system having a unitary flexible junction assembly installed at the intersection of a main wellbore and a lateral wellbore, according to one or more example embodiments.

Turning to FIGS. 1*a* and 1*b*, shown is an elevation view in partial cross-section of a multilateral wellbore completion system 10 utilized to complete wells intended to produce hydrocarbons from wellbore 12 extending through various earth strata in an oil and gas formation 14 located below the earth's surface 16. Wellbore 12 is formed of multiple bores, extending into the formation 14, and may be disposed in any orientation, such as lower main wellbore portion 12*a* and lateral wellbore 12*b* illustrated in FIGS. 1*a* and 1*b*.

Wellbore completion system 10 may include a rig or derrick 20. Rig 20 may include a hoisting apparatus 22, a travel block 24, and a swivel 26 for raising and lowering casing, drill pipe, coiled tubing, production tubing, work strings or other types of pipe or tubing strings, generally referred to herein as string 30. In FIGS. 1*a* and 1*b*, string 30 is substantially tubular, axially extending production tubing supporting a completion assembly as described below. String 30 may be a single string or multiple strings as discussed below.

Rig 20 may be located proximate to or spaced apart from wellhead 32, such as in the case of an offshore arrangement as shown in FIGS. 1*a* and 1*b*. One or more pressure control devices 34, such as blowout preventers (BOPs) and other equipment associated with drilling or producing a wellbore may also be provided at wellhead 32 or elsewhere in the system 10.

For offshore operations, as shown in FIGS. 1*a* and 1*b*, rig 20 may be mounted on an oil or gas platform 36, such as the offshore platform as illustrated, semi-submersibles, drill ships, and the like (not shown). Although system 10 of FIGS. 1*a* and 1*b* is illustrated as being a marine-based multilateral completion system, system 10 of FIGS. 1*a* and 1*b* may be deployed on land. In any event, for marine-based systems, one or more subsea conduits or risers 38 extend from deck 40 of platform 36 to a subsea wellhead 32. Tubing string 30 extends down from rig 20, through subsea conduit 38 and BOP 34 into wellbore 12.

A working or service fluid source 42, such as a storage tank or vessel, may supply, via flow lines 44, a working fluid (not shown) pumped to the upper end of tubing string 30 and flow through string 30 to equipment disposed in wellbore 12, such as subsurface equipment 48. Working fluid source 42 may supply any fluid utilized in wellbore operations, including without limitation, drilling fluid, cement slurry, acidizing fluid, liquid water, steam or some other type of fluid. Production fluids, working fluids, cuttings and other debris returning to surface 16 from wellbore 12 may be directed by a flow line 44 to storage tanks 50 and/or processing systems 52, such as shakers, centrifuges, other types of liquid/gas separators and the like.

Figure 1C:
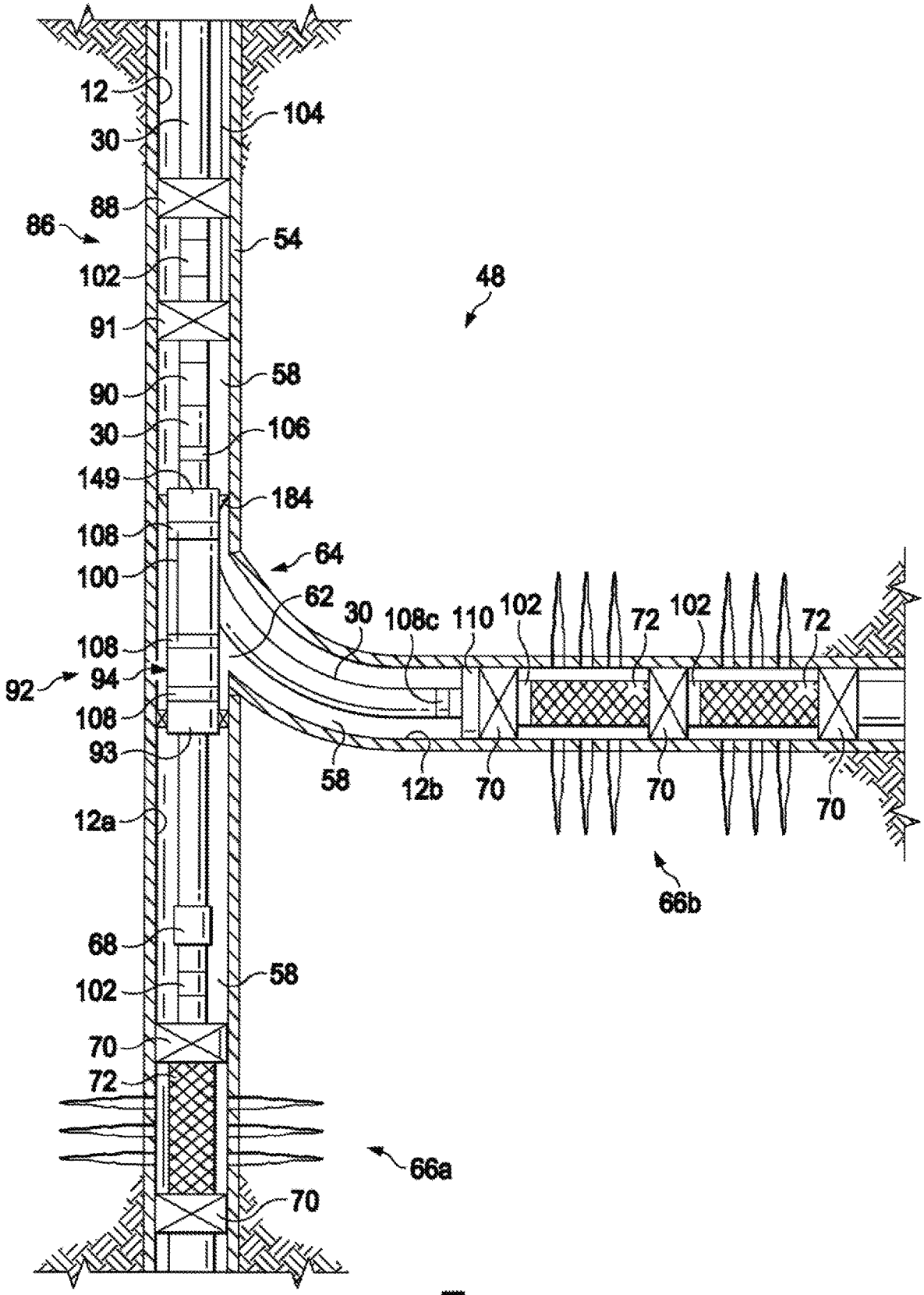
FIG. 1*c* is another representative partial cross-sectional view of a unitary junction assembly installed in a wellbore completion system with wireless energy transfer mechanisms deployed to permit energy and data transfer across the junction, according to one or more example embodiments.

With reference to FIG. 1*c* and ongoing reference to FIGS. 1*a* and 1*b*, all or a portion of the main wellbore 12*a* can be lined with liner or casing 54 that extends from the wellhead 32, which casing 54 may include the surface, intermediate and production casings. Casing 54 may be comprised of multiple strings with lower strings extending from or otherwise hung off an upper string utilizing a liner hanger 184. For purposes of the present disclosure, these multiple strings will be jointly referred to herein as the casing 54. An annulus 56 can be formed between the walls of sets of adjacent tubular components, such as concentric casing strings 54; or the wall of wellbore 12 and a casing string 54. For outer casing 54, all or a portion of the casing 54 may be secured within the main wellbore 12*a* by depositing cement 60 within the annulus 56 defined between the casing 54 and the wall of the main wellbore 12. In some embodiments, the casing 54 includes a window 62 formed therein at the intersection 64 between the main wellbore 12*a* and a lateral wellbore 12*b*. An annulus 58 can be formed between an exterior of string 30 and the inside wall of a casing string 54.

As shown in FIGS. 1*a*, 1*b* and 1*c*, subsurface equipment 48 is illustrated as completion equipment and the tubing string 30 shown in fluid communication with the completion equipment 48 is illustrated as production tubing string 30. Although completion equipment 48 can be disposed in a wellbore 12 of any orientation, for purposes of illustration, completion equipment 48 is shown disposed in the main wellbore 12*a*, and a substantially horizontal portion of lateral wellbore 12*b*. Completion equipment 48 may include a lower completion assembly 66 having various tools, such as an orientation and alignment subassembly 68, one or more packers 70 and one or more sand control screen assemblies 72. Lower completion assembly 66*a* is shown disposed in main wellbore 12*a*, while lower completion assembly 66*b* is shown disposed in lateral wellbore 12*b*. It will be appreciated that the foregoing is simply illustrative and that lower completion assembly 66 is not limited to particular equipment or a particular configuration.

Disposed in wellbore 12 at the lower end of tubing string(s) 30 is an upper completion assembly 86 that may include various equipment such as packers 88, flow control modules 90 and operational devices 102, such as sensors or actuators, computers, (micro) processors, logic devices, other flow control valves, digital infrastructure, optical fiber, Intelligent Inflow Control Devices (ICDs), seismic sensors, vibration inducers and sensors and the like. The upper completion assembly 86 may also include an energy transfer mechanism (ETM) 91, which may be wired or wireless, such as an inductive coupler segment. In the case of a wireless ETM, (or WETM), although the disclosure contemplates any WETM utilized to wirelessly transfer power and/or communication signals, in specific embodiments, the wireless ETMs discussed herein may be inductive coupler coils or other electric components, and for the purposes of illustration, will be referred to herein generally as an inductive coupler segments.

It will be appreciated that the ETMs generally, and WETMs specifically, may be used for a variety of purposes, including but not limited to transferring energy, transferring control and data signals, gathering data from sensors, communicating with sensors or other operational devices, controlling operational devices along the length of the lateral completion assembly, charging batteries, long-term storage capacitors or other energy storage devices deployed downhole, powering/controlling/regulating Inflow Control Devices ("ICDs"), etc. In one or more embodiments ETM 91 is in electrical communication with packer 88 and/or flow control modules 90 and/or operational devices 102 or may otherwise comprise operational devices 102. ETM 91 may be integrally formed as part of packer 88 or flow control module 90, or separate therefrom. ETM 91 may be an inductive coupler segment 91 or some other WETM. The ETM's can be used to enable communication between completion assembly equipment in a lateral (and/or twig or branch) wellbore and a controller at a remote location (such as at the surface, in the main wellbore, etc.) thereby allowing the controller to control the completion assembly equipment during production, injection, treatment, and other wellbore operations involving the lateral.

As used herein, "lateral" wellbore refers to a wellbore drilled through a wall of a primary wellbore and extending through the earth formation. This can include drilling a lateral wellbore from a main wellbore, as well as drilling a lateral wellbore from another lateral wellbore (which is sometimes referred to as a "twig" or "branch" wellbore). As used herein, "communication" or any grammatical variations refer to the transmission of signals (such as power, data, control, etc.) from a source to a destination. As used herein, "main wellbore" refers to a wellbore from which a lateral is drilled. This can include the initial wellbore of the wellbore system 10 from which a lateral wellbore is drilled, or a lateral wellbore from which another lateral wellbore is drilled (such as with a twig or branch wellbore).

At the intersection 64 of the main wellbore 12*a* and the lateral wellbore 12*b* is a junction assembly 92 engaging a location mechanism 93 secured within main wellbore 12*a*. The location mechanism 93 serves to support the junction assembly 92 at a desired vertical location within casing 54, and may also maintain the junction assembly 92 in a predetermined rotational orientation with respect to the casing 54 and the window 62. Location mechanism 93 may be any device utilized to vertically (relative to the primary axis of main wellbore 12*a*) secure equipment within wellbore 12*a*, such as a latch mechanism. In one or more embodiments, junction assembly 92 is a deformable junction that generally comprises a deformable, unitary conduit 96 (see FIG. 3). In one or more embodiments, junction assembly 92 may be a rigid conduit 95. In embodiments of junction assembly 92 where junction assembly 92 is a deformable junction that comprises a deformable conduit 96, the junction assembly 92 may be deployed with a deflector 94 (see FIG. 2) which may be disposed to engage the location mechanism 93. In other embodiments, junction assembly 92 may comprise deflector 94. Junction assembly 92 generally permits communication between the upper portion of wellbore 12 and both the lower portion of wellbore 12*a* and the lateral wellbore 12*b*. In this regard, junction assembly 92 may be in fluid communication with upper completion assembly 86. In one or more embodiments, junction assembly 92 is a unitary assembly in that it is installed as a single, assembled component or otherwise, integrally assembled before installation at intersection 64. Such a unitary assembly, as will be discussed in more detail below, permits inductive coupling communication to both the lower main wellbore 12*a* and the lateral wellbore 12*b* without the need for wet connections or physical couplings, while at the same time minimizing the sealing issues prevalent in the prior art as explained below.

Significantly, such a unitary assembly minimizes the likelihood that debris within the wellbore fluids will inhibit sealing at the junction 64. Commonly, wellbore fluid has 3% or more suspended solids, which can settle out in areas such as junction 64 causing the seals in the area to be in-effective. Because of this, prior art junctions installed in multiple pieces or steps, cannot readily provide reliable high-pressure containment (>2,500-psi for example) and wireless power/communications simultaneously. Debris can become trapped between components of the prior art multi-part junctions as they are assembled downhole, jeopardizing proper mating and sealing between components. Further drawbacks can be experienced to the extent the multi-part junctions are non-circular, which is a common characteristic of many prior art junction assemblies. In this regard, a multi-part junction which requires the downhole assembly (or engagement) of non-circular components is prone to leakage due to 1) the environment and 2) inability to remove debris from the sealing areas.

The typical downhole environment where a multi-piece junction is assembled is contaminated with drilling solids suspended in the fluid. In addition, the multi-piece junction is assembled in a location where metal shavings are likely to exist from milling a window (hole) in the side of the casing. The metal shavings can fall out into the union of the main bore casing and the lateral wellbore. This area is large and non-circular which makes it very difficult to flush the shavings and drill cuttings out of the area. Furthermore, the sealing areas of a multi-part junction are not circular (non-circular) which prevents the sealing areas from being fully "wiped cleaned" to remove the metal shavings and drill cuttings prior to engagement of the seals and the sealing surfaces. In addition, the sealing surfaces may contain square shoulders, channels, and/or grooves which can further inhibit cleaning of all of the drilling debris from them. Notably, in many cases, because of the non-circular nature of the components between which a seal is to be established, traditional elastomeric seals may not be readily utilized, but rather, sealing must be accomplished with metallic sealing components such as labyrinth seals. As is known in the industry labyrinth seals typically do not provide the same degree of sealing as elastomeric seals. Moreover, being made of metal interleaved surfaces, the seal components will be difficult to clean prior to engagement with one another.

In contrast, a unitary junction assembly 92 (as well as the unitary multibranch inflow control (MIC) junction assembly 200, see FIGS. 8-15) as described herein is assembled on the surface in a clean environment so that all sealed connections can be inspected, cleaned prior to assembly and then pressure-tested before being run into the well. Moreover, the unitary junction assembly 92 (and the unitary MIC junction assembly 200) eliminates the need for labyrinth seals as found in the prior art junction assemblies. Extending along each of lower completion assemblies 66*a*, 66*b* is one or more control lines or cables 100 mounted along either the interior or exterior of lower completion assembly 66. Control lines 100 may pass through packers 70 and may be operably associated with one or more operational devices 102 of the lower completion assembly 66. Operational devices 102 may include sensors or actuators, controllers, computers, (micro) processors, logic devices, other flow control valves, digital infrastructure, optical fiber, Intelligent Inflow Control Devices (ICDs), seismic sensors, ETMs, WETMs, vibration inducers and sensors and the like, as well as other inductive coupler segments.

Control lines 100 may operate as communication media, to transmit power, or data and the like between a lower completion assembly 66 and an upper completion assembly 86 via junction assembly 92. Data and other information may be communicated via telemetry that can monitor and control the conditions of the environment and various tools in lower completion assembly 66 or other tool strings. The control lines 100, ETMs, control lines 104, and junction assembly 92 can work together to communicate telemetry data and power between lower completion assemblies 66*a*, 66*b* and an upper completion assembly 86. Likewise, control lines 100, control lines 104, ETMs, the junction assembly 92, and the unitary MIC Junction assembly 200 can work together to communicate telemetry data and power between the lower completion assemblies 66*a*, 66*b* (via upper completion assembly 86), the lower completion assembly 66*c* and the surface equipment. Additional lower completion assemblies can be added to this communication network as needed when additional lateral wellbores (and/or twig or branch wellbores) are drilled and completed.

Extending uphole from upper completion assembly 86 are one or more control lines 104 which can extend to the surface 16. Control lines 104 may be electrical, hydraulic, optical, or other lines. Control lines 104 may operate as communication media, to transfer power, signals, data and the like between a controller, commonly at or near the surface (not shown), and the upper and lower completion assemblies 86, 66, respectively.

Carried on production tubing 30 is an ETM 106 as will be described in more detail below, with a control line 104 extending from ETM 106 to surface 16. In one or more embodiments, ETM is a WETM, and may be in the form of an inductive coupler segment 106. However, the control line 104 is not required to extend to the surface. It could alternatively, or in addition to, extend to a remote location within the wellbore system 10.

Likewise, deployed in association with junction assembly 92 are two or more ETMs 108, at least of which, one is a WETM, with one or more control lines 100 extending from junction assembly 92. More specifically, in one or more embodiments, junction assembly 92 can include an upper ETM 108*a*, which is preferably in the form of a WETM, and for the main wellbore 12*a* and the lateral wellbore 12*b*, junction assembly 92 can include a WETM 108*b*, 108*c*, respectively, preferably in the form of inductive coupler segments where the inductive coupler segments 108*b*, 108*c* communicate via control lines with an upper ETM 108*a* which are all carried on junction assembly 92. In one or more embodiments, in the case of inductive coupler segments 108*b*, 108*c*, each WETM is downhole from the intersection 64 when junction assembly 92 is installed in wellbore 12.

Figure 4:
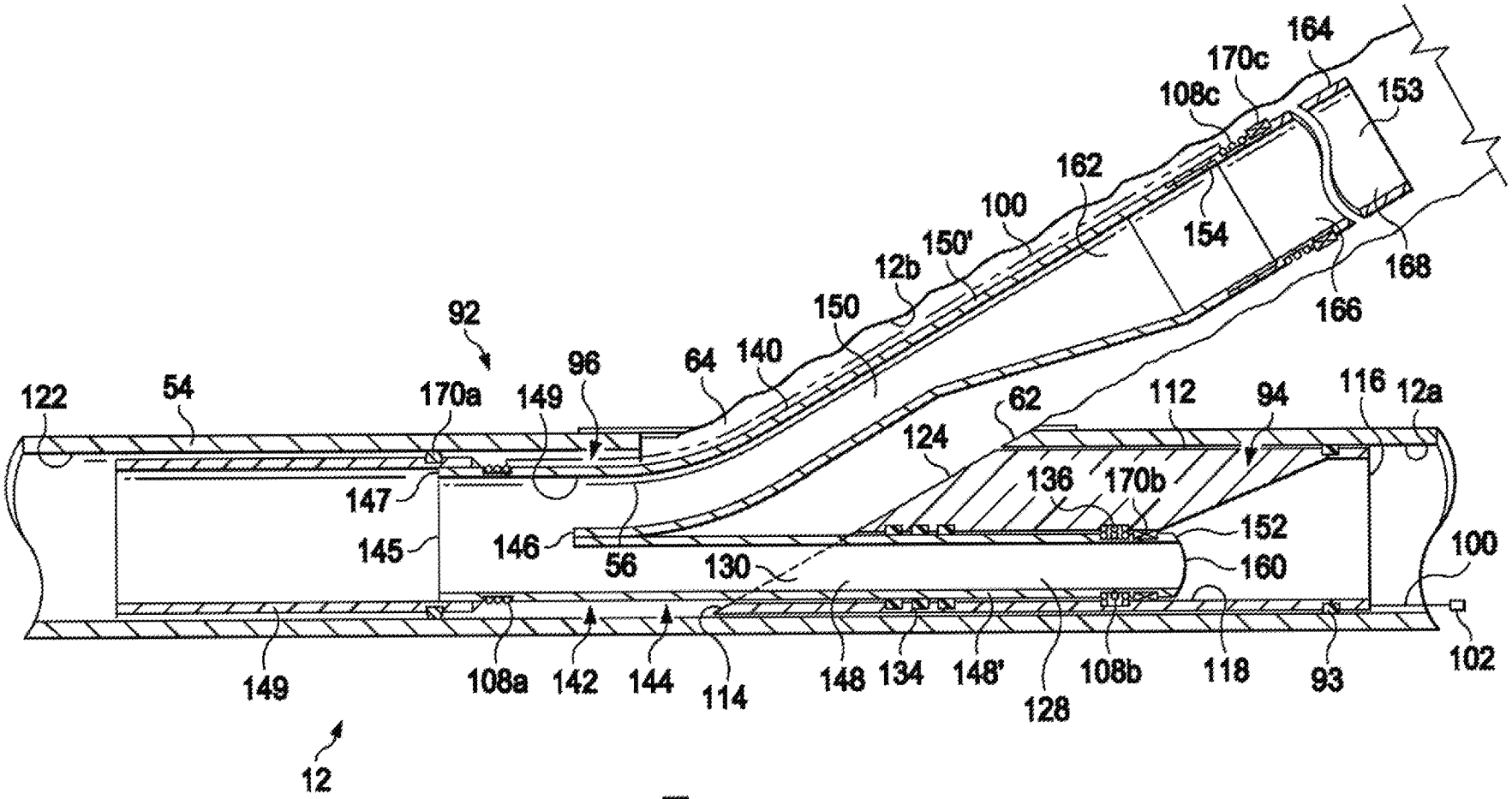
FIG. 4 is a representative partial cross-sectional view of the unitary junction assembly of FIG. 3 engaged with the deflector of FIG. 2, according to one or more example embodiments.

Finally, at least one ETM 110, and preferably a WETM such as an inductive coupler segment, is deployed in lateral wellbore 12*b* in association with lower completion assembly 66*b*. It will be appreciated that when two WETMs are axially aligned (such as is shown in FIG. 4 by inductive coupler segments 108*b* and 136), wireless coupling between the aligned coupler segments can permit wireless transfer between the segments of power and/or monitoring and control signals. This is particularly true where the WETMs are inductive coupler segments so as to facilitate inductive coupling between the WETMs. While in some embodiments, the two aligned inductive coupler segments are on opposite sides of a pressure barrier (such as within the interior of a pressure conduit and on the exterior of a pressure conduit), in other embodiments, the two inductive coupler segments may be on the same side of a pressure conduit, simply permitting a connector-less coupling for transmission of power and/or signals.

Figure 2:
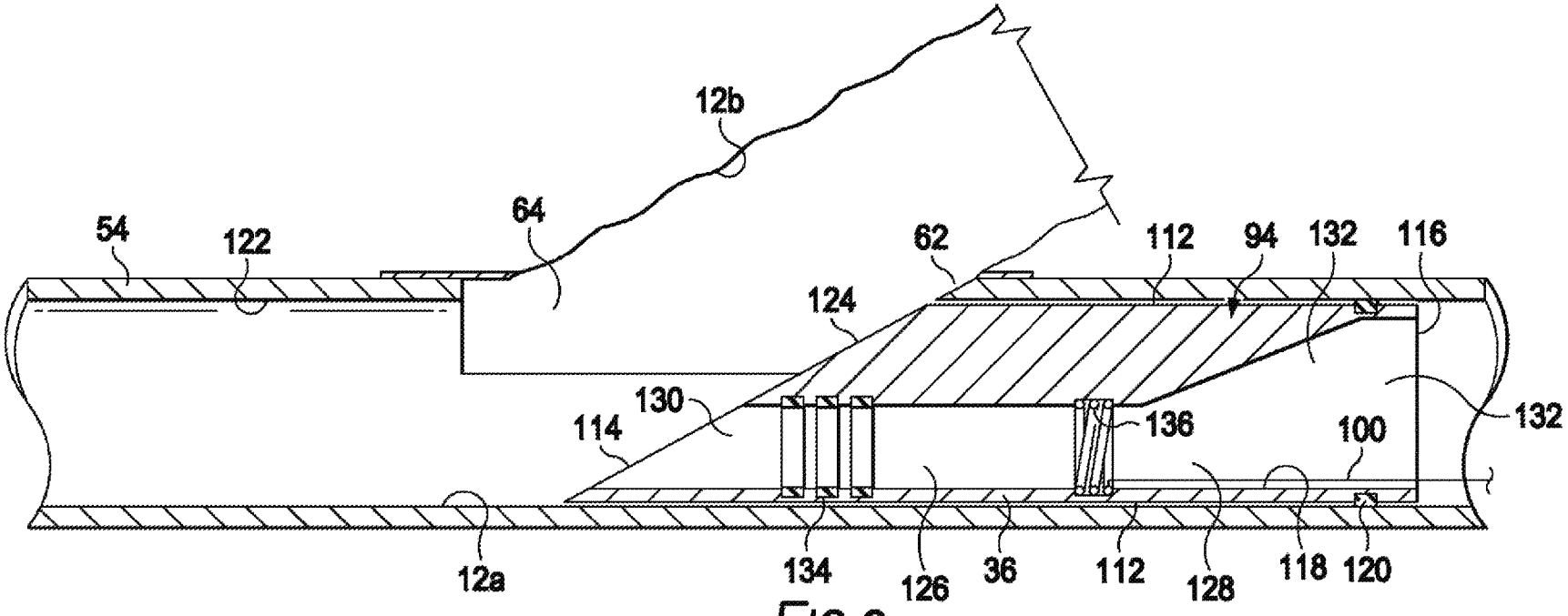
FIG. 2 is a representative partial cross-sectional view of the deflector installed in an offshore well completion system of FIG. 1*b*, according to one or more example embodiments.
Figure 3:
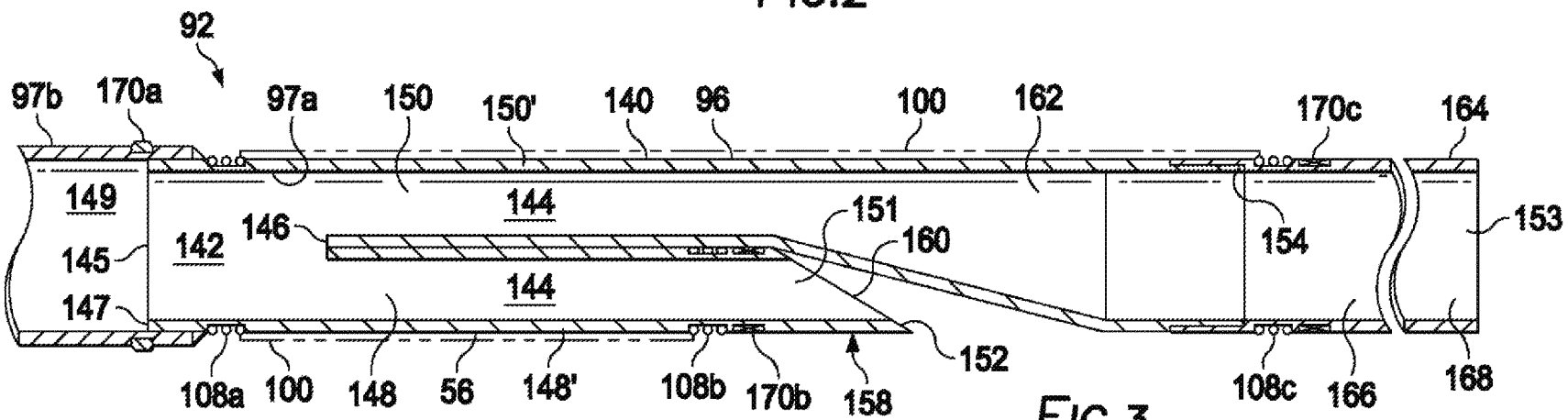
FIG. 3 is a representative partial cross-sectional view of the unitary junction assembly that can be installed in an offshore well completion system of FIG. 1*b*, according to one or more example embodiments.

Turning to FIGS. 2, 3 and 4, embodiments of unitary junction assembly 92 having a deformable conduit 96 are illustrated and generally include (a) an upper section for attachment to a pipe string and a first upper aperture; (b) a lower section comprising a primary passageway ending in a first lower aperture for fluid communication with a deflector and a secondary passageway ending in a second lower aperture for fluid communication with the secondary wellbore; and (c) a deformable portion. One or more of the passageways may be formed along a leg whereby the conduit is separated into the primary leg and the secondary leg, thereby forming a unitary multilateral junction, the unitary nature of which permits junction assembly 92 to be installed as a single unit that can more readily be used to transfer power and/or communication signals to both the lower main wellbore 12*a* and the lateral wellbore 12*b*. The deformable portion may be a leg or conduit junction located between the upper section and the lower section of the conduit.

The embodiments of junction assembly 92 illustrated in FIGS. 2, 3 and 4 may be deployed in conjunction with a deflector 94 which may be used to position junction assembly 92. With specific reference to FIGS. 2 and 4, deflector 94 is positioned along casing 54 adjacent the intersection 64 between the main wellbore 12*a* and lateral wellbore 12*b*. In particular, the deflector 94 is located distally to the intersection 64, adjacent or in close proximity to it, such that when equipment is inserted through the main wellbore 12*a*, the equipment can be deflected into the lateral wellbore 12*b* at the intersection 64 as a result of contact with the deflector 94. The deflector 94 may be anchored, installed or maintained in position within the main wellbore 12*a* using any suitable conventional apparatus, device or technique.

The deflector 94 has an external surface 112, an upper end 114, a lower end 116 and an internal surface 118. The external surface 112 of the deflector 94 may have any shape or configuration so long as the deflector 94 may be inserted in the main wellbore 12*a* in the manner described herein. In one or more embodiments, the external surface 112 of the deflector 94 is preferably substantially tubular or cylindrical such that the deflector 94 is generally circular on cross-section.

In preferred embodiments, the deflector 94 may include an orientation tool 93 positioned along external surface 112 to provide a seal between the external surface 112 of the deflector 94 and the internal surface 122 of the casing 54 of main wellbore 12*a*. Thus, wellbore fluids are inhibited from passing between the deflector 94 and the casing 54. As used herein, a seal assembly, such as the orientation tool 93, may be any conventional seal or sealing structure. For instance, a seal assembly such as the orientation tool 93 may be comprised of one or a combination of elastomeric or metal seals, packers, slips, liners or cementing. Likewise, a seal assembly such as the orientation tool 93 may also be a sealable surface. The orientation tool 93 may be located at, adjacent or in proximity to the lower end 116 of the deflector 94.

The deflector 94 further comprises a deflecting surface 124 located at the upper end 114 of the deflector 94 and a seat 126 for engagement with the junction assembly 92. When positioned in the main wellbore 12*a*, as shown in FIG. 2, the deflecting surface 124 is located adjacent the lateral wellbore 12*b* such that equipment inserted through the main wellbore 12*a* may be deflected into the lateral wellbore 12*b* to the extent the equipment cannot pass through deflector 94 as described below. The deflecting surface 124 may have any shape and dimensions suitable for performing this function, however, in preferred embodiments, the deflecting surface 124 provides a sloped surface which slopes from the upper end 114 of the deflector 94 downwards, towards the lower end 116 of the deflector 94.

The seat 126 of the deflector 94 may also have any suitable structure or configuration capable of engaging the junction assembly 92 to position or land the junction assembly 92 in the main and lateral wellbores 12*a*, 12*b* in the manner described herein. In the preferred embodiment, when viewing the deflector 94 from its upper end 114, the seat 126 is offset to one side opposite the deflecting surface 124.

Further, in the preferred embodiment, the deflector 94 further comprises a deflector bore 128 associated with the seat 126. The deflector bore 128 is associated with the seat 126, which engages the junction assembly 92, such that movement of fluids in the main wellbore 12*a* through the deflector 94 and through the junction assembly 92 is provided.

The deflector bore 128 extends through the deflector 94 from the upper end 114 to the lower end 116. The deflector bore 128 preferably includes an upper section 130, adjacent the upper end 114 of the conduit 94, communicating with a lower section 132, adjacent the lower end 116. Preferably, the seat 126 is associated with the upper section 130. Further, in the preferred embodiment, the seat 126 is comprised of all or a portion of the upper section 130 of the deflector bore 128. In particular, the upper section 130 is shaped or configured to closely engage the junction assembly 92 in the manner described below. The bore of the lower section 132 of the deflector bore 128 preferably expands from the upper section 130 to the lower end 116 of the deflector 94. In other words, the cross-sectional area of the lower section 132 increases towards the lower end 116. Preferably, the increase in cross-sectional area is gradual and the cross-sectional area of the lower section 132 adjacent the lower end 116 is as close as practically possible to the cross-sectional area of the lower end 116 of the deflector 94.

Disposed along bore 128 is a seal assembly 134 that can be any conventional seal assembly. For instance, the seal assembly 134 can be comprised of one or a combination of seals and sealing surfaces or friction fit surfaces. In one or more embodiments, seal assembly 134 is located along the inner surface 118 in upper section 130 of the deflector 94.

Deflector 94 further includes an ETM 136, and preferably, a WETM 136, mounted thereon. In one or more embodiments, WETM 136 is inductive coupler segment, and for purposes of this discussion, without intending to limit the WETM 136, will be discussed as an inductive coupler segment. While the inductive coupler segment 136 may be mounted internally or externally along deflector 94, in one or more embodiments, inductive coupler segment 136 is deployed internally along bore 128. In one or more preferred embodiments, inductor segment 136 is mounted upstream of seals 134 between the seals 134 and the upper end 114 with one or more cables 100 extending down from deflector 94 to lower completion assembly 66*a* and routed adjacent the seals 134, such as through the thicker portion of the deflector 94. Likewise, in one or more preferred embodiments, inductor segment 136 is mounted downstream of seals 134 between seals 134 and lower end 116 so that a cable 100 extending down from deflector 94 to lower completion assembly 66*a* does not interfere with seal 134. In this regard, inductive coupler segment 136 is preferably located below seat 126.

Referring to FIGS. 3 and 4, junction assembly 92 may be comprised of a conduit 96 having a deformable portion with an outside surface 140 as described below. In some embodiments, the conduit 96 is generally tubular or cylindrical in shape such that the conduit 96 is generally circular on cross-section and defines an outside diameter. In some embodiments, conduit 96 may have a D-shaped cross-section, while in other embodiments, conduit 96 may have other cross-sectional shapes. Conduit 96 includes an upper section 142, a lower section 144 and a conduit junction 146. In one or more embodiments, the conduit junction 146 is the deformable portion, while in other embodiments, the conduit junction is rigid and one or both of the conduit legs is deformable. The upper section 142 is comprised of a proximal end 147 opposing the conduit junction 146 with a first upper aperture 145 defined in the upper section 142. Thus, the upper section 142 extends from the junction 146, in a direction away from the lower section 144, for a desired length to the proximal end 147. In addition, the upper section 142 may further include a polished bore receptacle (PBR) 149 shown in FIG. 4, either integrally formed or secured to proximal end 147. The junction assembly 92 may include a liner hanger 184 in combination with the conduit 96 to support the conduit in the wellbore 12.

In one or more embodiments, the conduit 96 is unitary. In this regard, conduit 96 may be integrally formed, in that the upper section 142, the lower section 144 and the conduit junction 146 are comprised of a single piece or structure. Alternately, the conduit 96, and each of the upper section 142, the lower section 144 and the conduit junction 146, may be formed by interconnecting or joining together two or more pieces or portions that are assembled into a unitary structure prior to deployment in wellbore 12.

The lower section 144 is comprised of (i) a primary leg 148 having a wall 148', the primary leg 148 extending from the conduit junction 146 and (ii) a secondary or lateral leg 150 having a wall 150', the lateral leg 150 extending from the conduit junction 146. The primary leg 148 is capable of engaging the seat 126 (see FIG. 2) of the deflector 94, while the lateral leg 150 is capable of being inserted into the lateral wellbore 12*b*. The conduit junction 146 is located between the upper section 142 and the lower section 144 of the conduit 96 comprising the junction assembly 92, whereby the conduit 96, and in particular the lower section 144, is separated or divided into the primary and lateral legs 148, 150.

The primary leg 148 has a distal end 152 opposing the conduit junction 146 with a first lower aperture 151 defined at the distal end 152. Thus, the primary leg 148 extends from the conduit junction 146, in a direction away from the upper section 142 of the conduit 96, for a desired length to the distal end 152 of the primary leg 148. In the preferred embodiment, the primary leg 148 is tubular or hollow such that fluid may be conducted between the first upper aperture 145 of the upper section 142, past the conduit junction 146 to the first lower aperture 151 of the distal end 152. Thus, fluid may be conducted through the main wellbore 12*a* by passing through the conduit 96 of the junction assembly 92 and the deflector bore 128 of the deflector 94.

The secondary or lateral leg 150 also has a distal end 154 opposing the junction 146 with a second lower aperture 153 defined at the distal end 154. Thus, the lateral leg 150 extends from the conduit junction 146, in a direction away from the upper section 142 of the conduit 96, for a desired length to the distal end 154 of the lateral leg 150. The lateral leg 150 is tubular or hollow for conducting fluid between the first upper aperture 145 of the upper section 142, past the conduit junction 146 to the second lower aperture 153 of the distal end 154. In the illustrated embodiment, lateral leg 150 is deformable. In other embodiments, both legs 148, 150 may be deformable. As used herein, "deformable" means any pliable, movable, flexible or malleable conduit that can be readily manipulated to a desired shape. The conduit may either retain the desired shape or return to its original shape when the deforming forces or conditions are removed from the conduit. For example, lateral leg 150 can be movable or can flex relative to primary leg 148 due to conduit junction 142.

Junction assembly 92 further includes first, second and third inductive coupler segments 108*a*, 108*b* and 108*c*. First inductive coupler segment 108*a* is preferably positioned along upper section 142 between proximal end 147 and conduit junction 146. Second inductive coupler segment 108*b* can be positioned along primary leg 148 between conduit junction 146 and distal end 152, while a third optional inductive coupler segment 108*c* can be positioned along lateral leg 150 between conduit junction 146 and distal end 154. The third inductive coupler segment can be optional when the lower completion is connected to the junction 92 prior to being installed in the wellbore. In the case of second and third inductive coupler segments 108*b* and 108*c* (when used), the segments are preferably positioned adjacent the distal end 152, 154, respectively, of the primary leg 148 and lateral leg 150. Likewise, in the case of the inductive coupler segments 108*a*, 108*b* and 108*c*, they may be positioned either along the interior or exterior of junction assembly 92. In FIGS. 3 and 4, the inductive coupler segments 108*a*, 108*b* and 108*c* are illustrated as being positioned along the exterior of junction assembly 92. As illustrated, a cable 100 extends from the inductive coupler segment 108*a* down to each of the inductive coupler segments 108*b* and 108*c*. Because junction assembly 92 is unitary in nature, it allows the inductive coupler segment 108*a* to be readily connected to the inductive coupler segments 108*b* and 108*c* since the interconnections need not bridge separately installed components as would commonly occur in the prior art with multi-piece junction assemblies assembled downhole.

In any event, primary leg 148 may be of any length permitting the primary leg 148 to engage the seat 126 of the deflector 94 and inductive coupler segment 108*b* to be positioned in the vicinity of, and generally aligned with, inductive coupler segment 136 of deflector 94. In this regard, inductive coupler segments 136 and 108*b* may be on the same side of a pressure barrier, and thus, adjacent one another, or separated by a pressure barrier, and thus, simply aligned with one another. In any event, the lateral leg 150 may be of any length permitting the lateral leg 150 to be deflected into the lateral wellbore 12*b*. Further, the primary and lateral legs 148, 150 may be of any lengths relative to each other. However, in the preferred embodiment, the lateral leg 150 is longer than the primary leg 148 such that the distal end 154 of the lateral leg 150 extends beyond the distal end 152 of the primary leg 148 when the conduit junction 146 is substantially undeformed. With respect to the alignment of coupler segments, it will be understood that two segments may require axial alignment, circumferential alignment or both. ETM coupler segments can be a series of stacked, extra-long, and/or multi-tap coupler segments, as well as incorporating components and/or methods to ensure maximum transfer of energy from one coupler segment to a coupled coupler segment. A controller can be used to "tap" a desired section of coupler segments that most closely aligns with the coupled coupler segment.

In one or more preferred embodiments, when the lateral leg 150 is in a substantially undeformed position as shown in FIG. 3, the primary leg 148 and the lateral leg 150 are substantially parallel to each other. However, the primary and lateral legs 148, 150 need not be substantially parallel to each other, and the longitudinal axes of the primary and lateral legs 148, 150 need not be substantially parallel to the longitudinal axis of the conduit 96, as long as the conduit 96 may be inserted and lowered into the main wellbore 12*a* when the lateral leg 150 is in a substantially undeformed position.

When the junction assembly 92 is connected to a pipe string 30 and lowered in the main wellbore 12*a*, the lateral leg 150 is capable of being deflected into the lateral wellbore 12*b* by the deflector 94 such that the deformable conduit junction 146 becomes deformed and the primary leg 148 then engages the seat 126 of the deflector 94, as shown in FIG. 4. The deformable conduit junction 146 separates the primary leg 148 and the lateral leg 150 and permits the placement of the junction assembly 92 in the main and lateral wellbores 12*a*, 12*b*. As stated, the primary leg 148 is capable of engagement with the seat 126 of the deflector 94. Thus, the shape and configuration of the primary leg 148 is chosen or selected to be compatible with the seat 126, being the upper section 130 of the deflector bore 128 in the preferred embodiment.

Further, the seat 126 engages the primary leg 148 such that the movement of fluid in the main wellbore 12*a*, through the deflector 94 and the conduit 96, is provided. Preferably, the primary leg 148 engages the seat 126 to provide a sealed connection between the deflector 94 and the main wellbore 12*a*. Any conventional seal assembly 134 may be used to provide this sealed connection. For instance, the seal assembly 134 may be comprised of one or a combination of seals or a friction fit between the adjacent surfaces. In the preferred embodiment, the seal assembly 134 is located between the primary leg 148 and the upper section 130 of the deflector bore 128 when the primary leg 148 is seated or engages the seat 126. The seal assembly 134 may be associated with either the primary leg 148 or the upper section 130 of the deflector bore 128. However, preferably, the seal assembly 134 is associated with the upper section 130 of the deflector bore 128.

Primary leg 148 may include a guide 158 for guiding the primary leg 148 into engagement with the seat 126. The guide 158 may be positioned at any location along the length of the primary leg 148 which permits the guide 158 to perform its function. However, preferably, the guide 158 is located at, adjacent or in proximity to the distal end 152 of the primary leg 148. The guide 158 may be of any shape or configuration capable of guiding the primary leg 148. However, preferably the guide 158 has a rounded end 160 to facilitate transmission down the wellbore 12, as shown in FIGS. 2 and 4.

The lateral leg 150 may include an expansion section 162 located at, adjacent or in proximity to the distal end 154 of the lateral leg 150. The expansion section 162 comprises a cross-sectional expansion of the lateral leg 150 in order to increase its cross-sectional area. As indicated above, the length of the lateral leg 150 is greater than the length of the primary leg 148 in the preferred embodiment. Preferably, the lateral leg 150 commences its cross-sectional expansion to form the expansion section 162 at a distance from the conduit junction 146 approximately equal to or greater than the distance of the distal end 152 of the primary leg 148 from the conduit junction 146. Thus, when the conduit junction 146 is undeformed, the expansion section 162 is located beyond or distal to the distal end 152 of the primary leg 148 as shown in FIG. 3.

A liner 164 for lining the lateral wellbore 12*b* may extend from the lateral leg 150 of the conduit 96. The liner 164 may be any conventional liner, including a perforated liner, a slotted liner or a prepacked liner. In one or more embodiments, the liner 164 may form part of the lower completion assembly 66*b* in lateral wellbore 12*b*, while in other embodiments, liner 164 may be separate and generally in fluid communication with conduit 96. In any event, liner 164 includes a proximal end 166 and a distal end 168, where the proximal end 166 is attached to the distal end 154 of the lateral leg 150. The distal end 168 extends into the lateral wellbore 12*b* such that all or a portion of the lateral wellbore 12*b* is lined by the liner 164. Thus, junction assembly 92 may function to hang the liner 164 in the lateral wellbore 12*b*. Alternatively, as discussed below, a stinger 172 (see FIG. 5), may be attached to the distal end 154 of lateral leg 150 and utilized to transport liner 164 and/or other components of a lower completion assembly 66 (see FIG. 5) into lateral wellbore 12*b*.

The upper section 142 conducts fluid therethrough from the deformable conduit junction 146 to the proximal end 147. In the preferred embodiment, the upper section 142 permits the mixing or co-mingling of any fluids passing from the primary and lateral (or secondary) legs 148, 150 into the upper section 142. However, alternately, the upper section 142 may continue the segregation of the fluids from the primary and lateral legs 148, 150 through the upper section 142. Thus, the fluids are not permitted to mix or co-mingle in the upper section 142.

Figure 5:
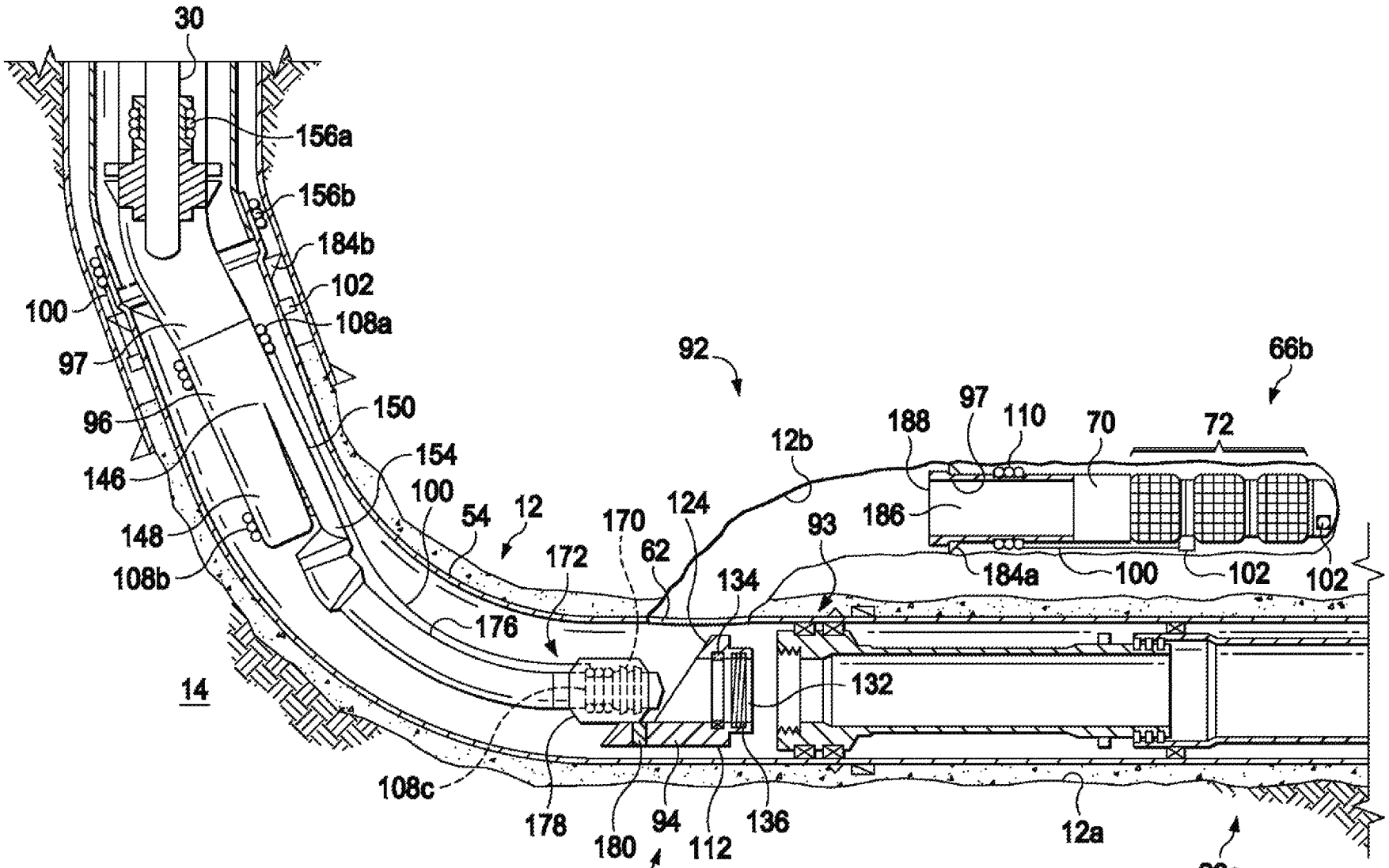
FIG. 5 is a representative partial cross-sectional view of the unitary junction assembly of FIG. 3 during deployment in a multilateral well completion system, prior to engagement with the deflector of FIG. 2, according to one or more example embodiments.

Junction assembly 92 may also include one or more seal assemblies 170 associated with it. Seal assemblies 170 may be carried on conduit 96 or may be carried on adjacent equipment, such as a liner hanger (see liner hanger 184*b* in FIG. 5) supporting junction assembly 92. As illustrated a seal assembly 170*a* is associated with the upper section 142 of the conduit 96, or may form or comprise a portion thereof, such that the seal assembly 170*a* provides a seal between the conduit 96 and casing 54 within the main wellbore 12*a*. Seal assembly 170*a* may be carried on conduit 96 such as shown in FIGS. 3 and 4, or some other adjacent equipment, such as shown in FIG. 5, but is generally provided to seal the upper section 142 of junction assembly 92. Preferably, the seal assembly 170*a* is located between the outside surface 140 of the upper section 142 of the conduit 96 (other liner hanger 84, as the case may be) and the internal surface 122 of casing 54. Thus, seal assembly 170*a* inhibits wellbore fluids from passing between the conduit 96 and the casing string 54.

A seal assembly 170*b* is shown positioned along primary leg 64, preferably adjacent distal end 152, and a seal assembly 170*c* is shown positioned along lateral leg 150, preferably adjacent distal end 154. The seal assembly 170 may be comprised of any conventional seal or sealing structure. For instance, the seal assembly 170 may be comprised of one or a combination of seals, packers, slips, liners or cementing.

In one or more embodiments, where inductive coupler segments that are cabled to one another are positioned so that consecutive inductive coupler segments are on the same tubular, such as inductive coupler segments 108*a*, 108*b*, 108*c* illustrated on conduit 96, and are within the same pressure barrier, it may be desirable to position the inductive coupler segments between sets of sealing elements, such as seal assemblies 170*a* and 170*b*. This prevents the need for a cable, such as cable 100, from straddling or extending across a pressure barrier. As used herein, pressure barrier may refer to a wall between an interior and exterior of a tubular, such as a string or casing, or may refer to a zone defined by successive sets of seal assemblies along a tubular.

In one or more embodiments where cooperating inductive coupler segments, i.e., inductive coupler segments disposed to wirelessly transfer power and/or signals therebetween, are positioned adjacent one another within the same pressure barrier (as opposed to simply aligned on opposite sides of a tubing wall), it may be necessary for a cable 100 extending to one of the inductive coupler segments to pass through a pressure barrier, such as a seal assembly, in order to electrically connect via cable 100 respective electrical components. For example, in FIG. 4, primary leg 148 of a junction assembly 92 is inserted into bore 128 of deflector 94. As shown, the inductive coupler segment 136 carried by deflector 94 is adjacent inductive coupler segment 108*b* carried by junction assembly 92. Because the inductive coupler segments 136, 108*b* are within the same pressure barrier, the cable 100 extending from one of the inductive coupler segments 136, 108*b* must extend through or around a seal assembly, such as is shown where cable 100 extends from inductive coupler segment 136 to a downhole operational device 102 passes through seal assembly 170*b* of deflector 94. In another embodiment, cable 100 may pass from the internal surface 118 to the external surface 112 of deflector 94 and then extend downhole along the external surface 112 of deflector 94.

Alternatively, it will be appreciated, that inductive coupler segment 136 may be located on the external surface 112 deflector 94 and simply aligned with inductive coupler segment 108*b* positioned on junction assembly 92 within the interior of deflector 94. In such case, no such pressure barrier need be crossed, and cable 100 may extend downhole to an operational device 102.

As best illustrated in FIG. 5, in one or more embodiments, junction assembly 92 may include a stinger 172 attached to the distal end 154 of lateral leg 150. In such case, the inductive coupler segment 108*c* of lateral leg 150 may be carried on stinger 172. More generally in FIG. 5, a lower completion assembly 66*a* is illustrated deployed in the lower portion of a main wellbore 12*a*, while a lower completion assembly 66*b* is illustrated deployed in a lateral wellbore 12*b*. Although lower completion assemblies 66 as described herein are not limited to a particular configuration, for purposes of illustration, lower completion assembly 66*b* is shown as having one or more sand control screen assemblies 72 and one or more packers 70 extending from a liner or hanger 184*a*, with a bore 186 extending therethrough. Lower completion assembly may also include at its proximal end 188 a polished bore receptacle, such as PBR 149 shown in FIG. 4.

Moreover, each lower completion assembly 66*a*, 66*b* may include an inductive coupler segment associated with the respective lower completion assembly 66*a*, 66*b*. In particular, at least lower completion assembly 66*b* includes an ETM 110 with inductive coupler segments associated with it. In particular, the ETM 110 is deployed along lower completion assembly 66*b* adjacent proximal end 188 for alignment with inductive coupler segment 108*c* as described below.

In FIG. 5, deflector 94 is illustrated being conveyed into the main wellbore 12*a* by junction assembly 92 and coupled to a latch mechanism 93. The deflector 94 is operatively coupled to string 30 via a junction assembly 92 and the stinger 172 to facilitate installation of the deflector 94. Once installed in the well 12, the junction assembly 92 may be configured to provide access to lower portions 12*a* of the main wellbore 12 via primary leg 148 and to the lateral wellbore 12*b* via lateral leg 150. The stinger 172 may include a stinger member 176 that is coupled to and extends from the lateral leg 150, a shroud 178 is positioned at a distal end of the stinger member 176, and one or more seal assemblies 170*c* (see also FIG. 3) are arranged within the shroud 178. Likewise, the shroud 178 may be disposed around a third inductive coupler segment 108*c* (see also FIG. 3) mounted adjacent seals 170*c*. In some embodiments, the shroud 178 may be coupled to the deflector 94 with one or more shear pins 180 or a similar mechanical fastener. In other embodiments, the shroud 178 may be coupled to the deflector 94 using other types of mechanical or hydraulic coupling mechanisms.

As previously described, junction assembly 92 includes the inductive coupler segments 108*a*, 108*b* and 108*c*, which can be either internally or externally along conduit 96. Moreover, junction assembly 92 may include a PBR 149 at its proximal end 147 with the upper inductive coupler segment 108*a* (not shown in FIG. 5) at the proximal end of junction assembly 92 being disposed along the PBR 149 of junction assembly 92.

Deflector 94 is conveyed into the wellbore 12 until it engages latch mechanism 93. Once the deflector 94 is properly connected to the latch mechanism 93, the string 30 may be detached from the deflector 94 at the stinger 172 and, more particularly, at the shroud 178. This may be accomplished by placing an axial load on the stinger 172 via the string 30 and shearing the shear pin(s) 180 that connect the stinger 172 to the deflector 94. Once the shear pin(s) 180 sheared, the stinger 172 may then be free to move with respect to the deflector 94 as manipulated by axial movement of the string 30. More particularly, with the deflector 94 connected to the latch mechanism 93 and the stinger 172 detached from the deflector 94, the string 30 may be advanced downhole within the main wellbore 12 to position lateral leg 150 and the stinger 172 within the lateral wellbore 12*b*. The diameter of the deflector bore 128 may be smaller than a diameter of the shroud 178, whereby the stinger 172 is prevented from entering the deflector bore 128 but the shroud 178 is instead forced to ride along deflecting surface 124 of deflector 94 and into the lateral wellbore 12*b*.

In one or more embodiments, any hanger 184 deployed within wellbore 12 may also include an inductive coupler segment 156*a* which can couple to the inductive coupler segment 156*b* of the junction assembly 92. In FIG. 5, a hanger 184*b* is illustrated as supporting production casing 54. It should also be understood that the deflector 94 is not required to be conveyed into the main wellbore 12*a* by junction assembly 92. The deflector 94 can be installed with the latch mechanism 93 prior to conveyance of the assembly 92.

Figure 6:
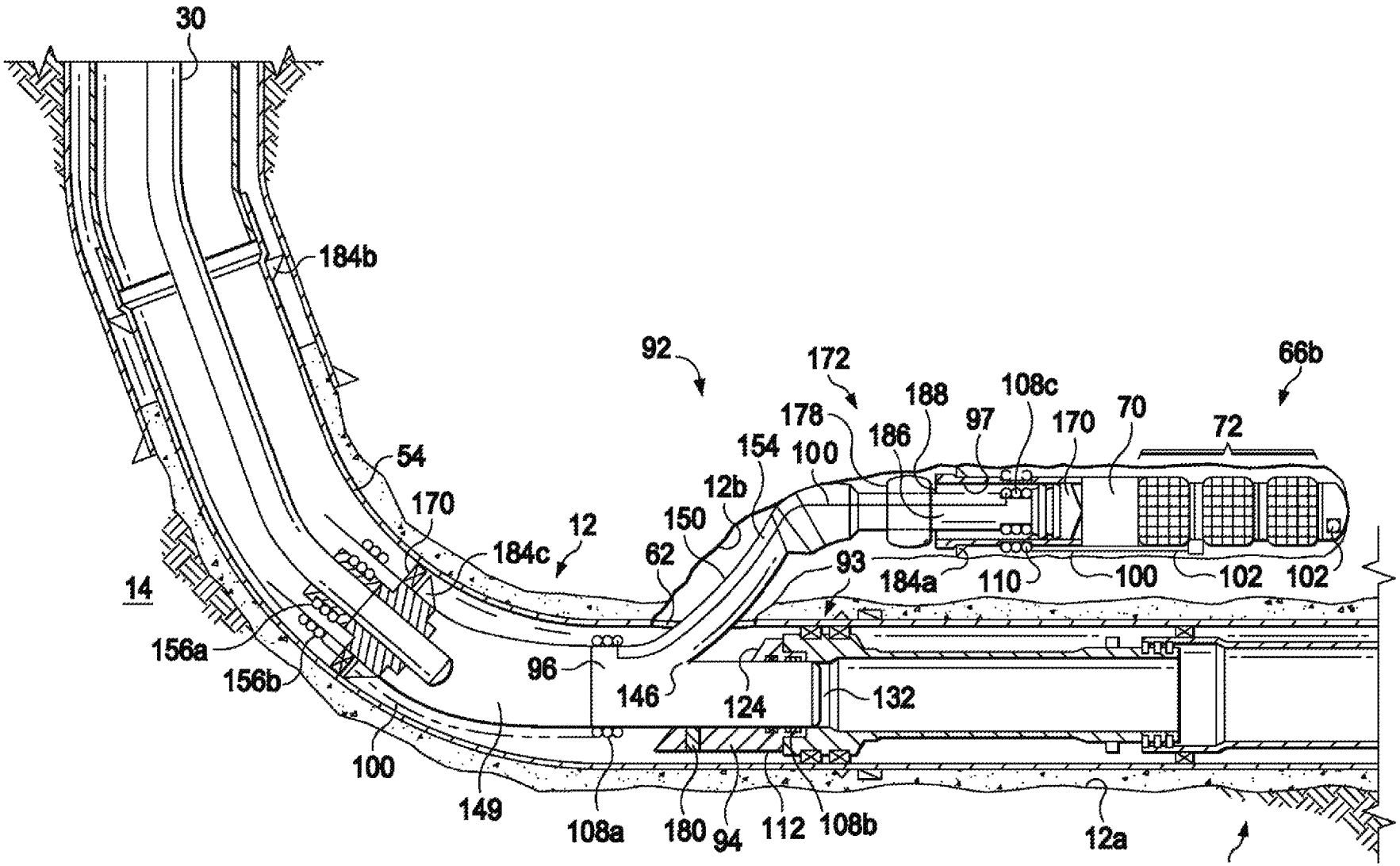
FIG. 6 is a representative partial cross-sectional view of the unitary junction assembly of FIG. 3 after deployment in a multilateral well completion system, engaged with the deflector of FIG. 2 and a lateral lower completion assembly, according to one or more example embodiments.

Referring to FIG. 6, the stinger 172 and the lateral leg 150 of the junction assembly 92 are depicted as positioned in the lateral wellbore 12*b* and engaging the lower completion assembly 66*b* of the lateral wellbore 12*b*. During deployment, the shroud 178 of stinger 172 engages the lower completion assembly 66*b*. In one or more embodiments, the diameter of the shroud 178 may be greater than a diameter of the bore 186 and, as a result, the shroud 178 may be prevented from entering the lower completion assembly 66*b*. Upon engaging the lower completion assembly 66*b*, weight may then be applied to the stinger 172 via the string 30, which may result in the shroud 178 detaching from the distal end of the stinger member 176. In some embodiments, for instance, one or more shear pins or other shearable devices (not shown) may be used to couple the shroud 178 to the distal end of the stinger member 176, and the applied axial load may surpass a shear limit of the shear pins, thereby releasing the shroud 178 from the stinger member 176. It will be appreciated that while a shroud 178 is described herein as a mechanism for protecting seal assemblies 170 and inductive coupler segment 108*c* during deployment, the disclosure is not limited to configurations with a shroud 178, and thus, in other embodiments, the shroud 178 may be eliminated.

With the shroud 178 released from the stinger member 176, the string 30 may be advanced further such that the shroud 178 slides along the outer surface of the stinger member 176 as the stinger member 176 advances into the lower completion assembly 66*b* where the stinger seals 170 sealingly engage the inner wall of bore 186 and the inductive coupler segment 108*c* carried on stinger 176 is generally aligned with an inductive coupler segment 110 carried on the lower completion assembly 66*b*. With the stinger seals 170 sealed within bore 186, fluid communication may be provided through the lateral wellbore 12*b*, including through the various components of lower completion assembly 66*b*.

Notably, advancing the string 30 downhole within the main wellbore 12 also advances the primary leg 148 until locating and being received within the deflector bore 128. The seal assembly 134 in the deflector bore 128 sealingly engages the outer surface of the primary leg 148 and the inductive coupler segment 108*b* carried on primary leg 64 of junction assembly 92 is positioned adjacent an inductive coupler segment 136 of the deflector 94.

When deployed as described herein, the unitary junction assembly 92 permits power and/or data signals to be transferred to locations in both the main wellbore 12*a* below the intersection 64 and the lateral wellbore 12*b*. Such an arrangement is particularly desirable because it eliminates the need to overcome multiple separate wellbore components traditionally installed at an intersection 64 between wellbores 12*a*, 12*b*. The arrangement also enables monitoring and flow control of individual segments in each lateral 17*a*, 17*b*, 17*c*, 18*a*, 18*b*, and 18*c*.

Figure 7:
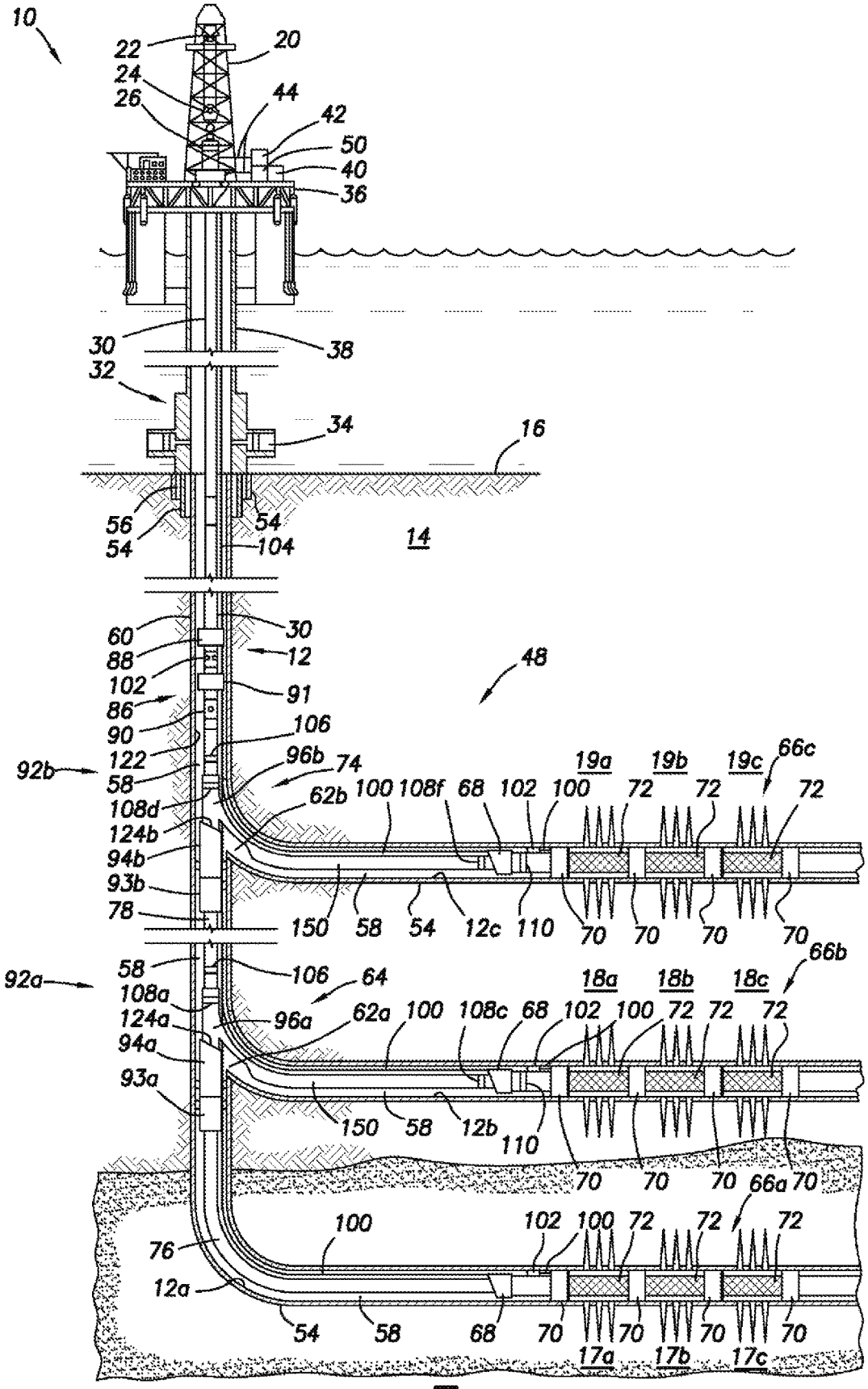
FIG. 7 is a representative partial cross-sectional view of an offshore well completion system having a unitary junction assembly installed at multiple intersections of lateral wellbores and a main wellbore, according to one or more example embodiments.

Turning to FIG. 7, shown is an elevation view in partial cross-section is a multilateral wellbore completion system 10 with two lateral wellbores 12*b*, 12*c* and two intersections 64, 74. It should be understood that any number of intersections of lateral wellbores can be accommodated with the wellbore completion system 10. The lower completion equipment 66*a*, 66*b* and a lower junction assembly 92*a* can be installed at the intersection 64 as described above. Once junction assembly 92*a* is installed, an intermediate completion assembly (or tubing string) 78 can be installed with its distal end coupled to the PBR 149 of the junction assembly 92*a*, with a deflector 94*b* and location mechanism 93*b* positioned at its proximal end.

The deflector 94*b* can be positioned along the casing 54 adjacent the intersection 74 between the main wellbore 12*a* and lateral wellbore 12*c*. In particular, the deflector 94*b* is located adjacent or in close proximity to it the intersection 74 such that when equipment is inserted through the main wellbore 12*a*, the equipment can be deflected into the lateral wellbore 12*c* at the intersection 74 as a result of contact with the deflector 94*b*. The deflector 94 may be anchored, installed or maintained in position within the main wellbore 12*a* using any suitable conventional apparatus, device or technique, such as the location mechanism 93*b*. The lower completion assembly 66*c* and the junction assembly 92*b* can be installed to provide fluid communication between the upper wellbore 12, and the main wellbore 12*a* and lateral wellbores 12*b*, 12*c*. This process can continue when installing junction assemblies in additional intersections in the wellbore 12 as the multilateral wellbore completion system 10 is assembled and fluids are produced from and/or injected into the wellbore 12.

Figure 8:
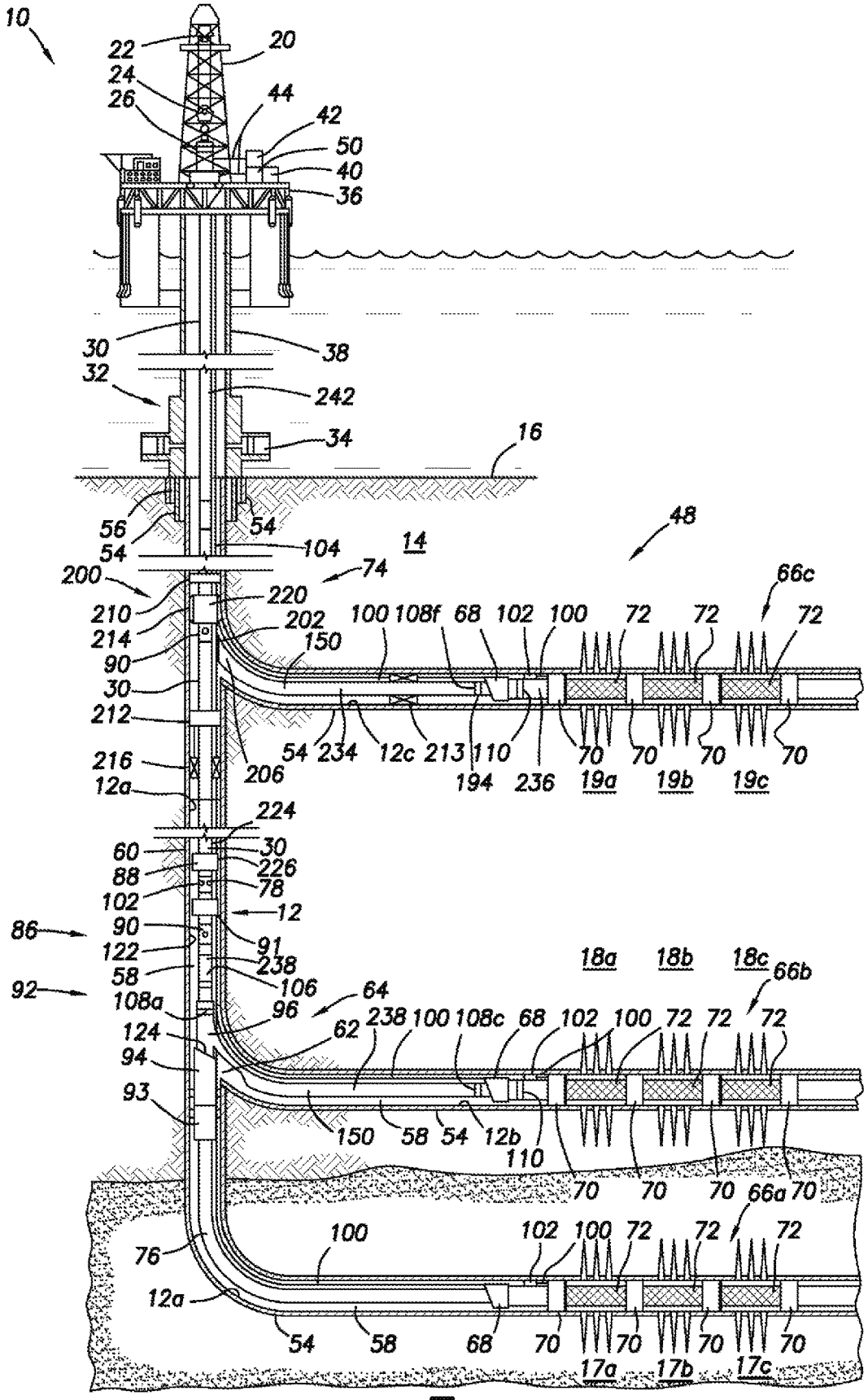
FIG. 8 is a representative partial cross-sectional view of an offshore well completion system having a unitary junction assembly installed at a lower intersection of a lateral wellbore and a main wellbore, and a multibranch inflow control unitary (MIC) junction assembly installed at an upper intersection of a lateral wellbore and the main wellbore, according to one or more example embodiments.

FIGS. 7 and 8 each show intervals 17*a-c*, 18*a-c*, 19*a-c* of the respective wellbores 12*a*, 12*b*, 12*c*. The junction assemblies 92 in FIGS. 7 and 8, as well as the multibranch inflow control (MIC) junction 200 in FIG. 8 provide for communication to the completion equipment in the lower completion assemblies (or tubing strings) 66*a*, 66*b*, 66*c*, via ETMs 91, 156, 108, 110 as generally described above (as well as ETMs 212, 214 described below). The communication to the lower completion assemblies 66*a*, 66*b*, 66*c* can individually control fluid flow between the tubing string and the earth formation in each of these intervals. The communication can also transmit sensor data from each interval 17*a-c*, 18*a-c*, 19*a-c* to the surface (or other location) for monitoring such things as interval pressures, fluid composition, fluid flow rates, equipment health, water coning, etc.

As used herein, "intervals" refer to formation intervals. The formation intervals may be considered layers within the formation. Additionally, the formation intervals can be identified by changes in characteristics of the formation such as a change in permeability, and/or elevation, and/or a change in what a particular formation interval may contain (e.g. oil, water, gas, etc.).

Turning to FIG. 8, shown is an elevation view in partial cross-section of the example multilateral wellbore completion system 10 of FIG. 7 with two lateral wellbores 12*b*, 12*c* and two intersections 64, 74. A junction assembly 92 is installed at intersection 64 similarly as described above. A unitary multibranch inflow control (MIC) junction assembly 200 is installed at intersection 74, which not only provides communication to the lower completion assembly 66*c*, but also allows a tubing string to extend through the MIC junction assembly and connect (or otherwise couple) to the upper completion equipment 86 (i.e. tubing string 78), thereby providing communication to the lower completion assemblies 66*a*, 66*b*. The tubing string 30 can extend through the unitary MIC junction assembly 200 and land in a PBR above the packer 88. The ETM 91 can establish communication between the tubing string 30 and the upper completion assembly 86, as well as the lower completion assemblies 66*a*, 66*b*. It should be understood that this is merely an exemplary configuration of the unitary MIC junction assembly 200, which can be used to allow extension of the tubing string 30 through the unitary MIC junction assembly to access the lower tubing strings 78, 76 and the lower completion assemblies 66*a*, 66*b*.

Figure 9:
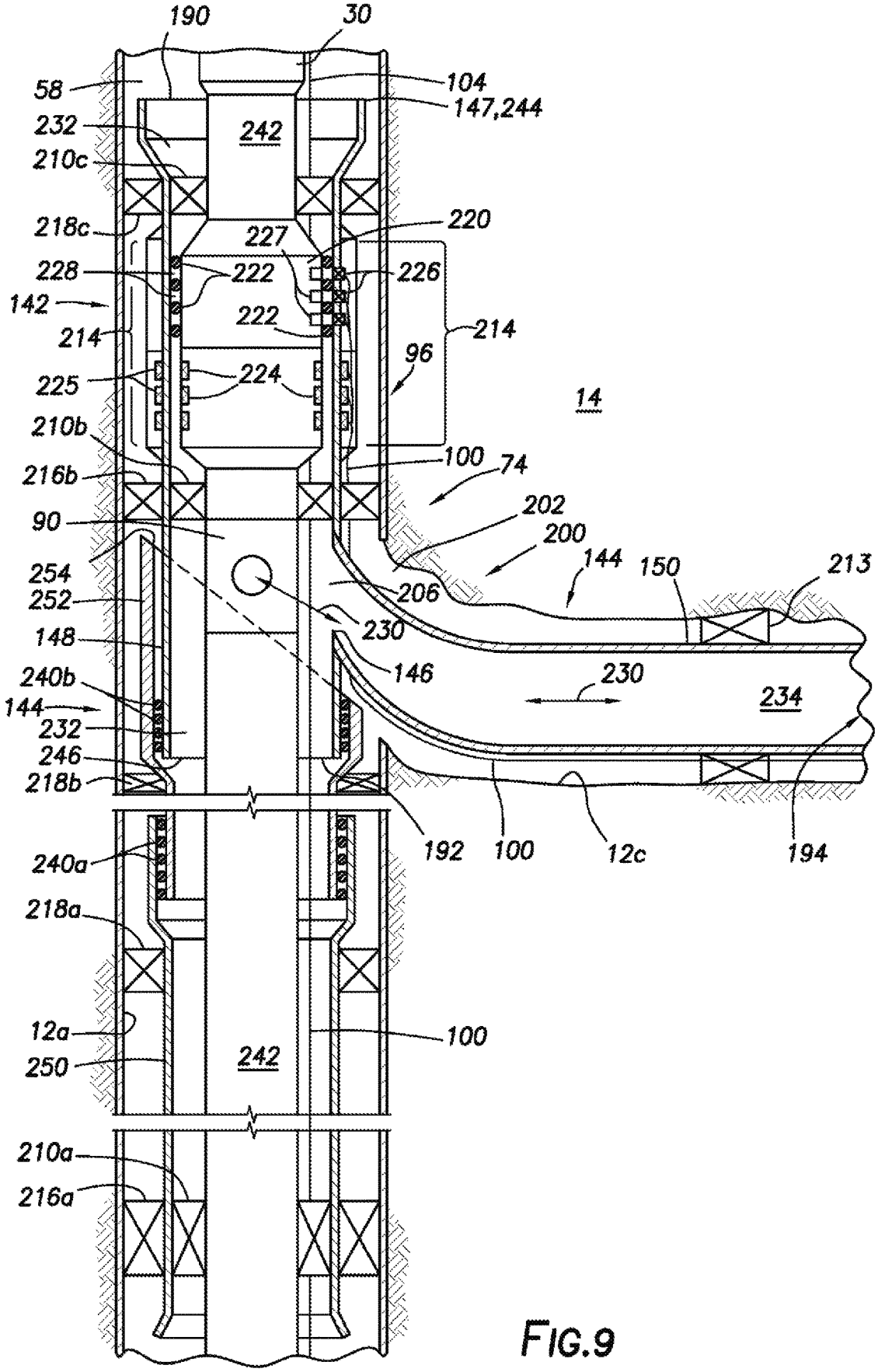
FIG. 9 is a representative partial cross-sectional view of a unitary multibranch inflow control (MIC) junction assembly installed at an intersection of a lateral wellbore and a main wellbore, according to one or more example embodiments.

Turning to FIG. 9, shown is a partial cross-section view of a multibranch inflow control (MIC) junction 200 installed at the intersection 74 of the lateral wellbore 12*c* and the main wellbore 12*a*. In one or more embodiments, the conduit 206 is unitary. In this regard, conduit 206 may be integrally formed, in that the upper section 142, the lower section 144 and the conduit junction 146 are comprised of a single piece or structure. Alternately, the conduit 206, and each of the upper section 142, the lower section 144 and the conduit junction 146, may be formed by interconnecting or joining together two or more pieces or portions that are assembled into a unitary structure prior to deployment in wellbore 12.

Embodiments of the unitary MIC junction assembly 200 having a deformable conduit 206 are illustrated and generally include (a) the upper section 142 for coupling to a tubing string 30 and an upper aperture 190; (b) the lower section 144 comprising a primary passageway 232 beginning in the upper aperture 190 and ending in a lower aperture 192 for fluid communication and a secondary passageway 234 ending in another lower aperture 194 for fluid communication with the secondary wellbore 12*c*; and (c) a deformable portion. One or more of the passageways 232, 234 may be formed along a leg whereby the conduit 206 is separated into the primary leg 148 and the lateral leg 150, thereby forming a unitary MIC junction assembly 200, the unitary nature of which permits the unitary MIC junction assembly 200 to be installed as a single unit that can more readily be used to transfer power and/or communication signals to both the lower completion assemblies 66*a*, 66*c* in respective wellbores 12*a*, 12*c*. The deformable portion may be a leg 148, 150 or conduit junction 146 located between the upper section 142 and the lower section 144 of the conduit 206, and/or a combination thereof.

The liner 250 can be installed below the intersection 74 in the main wellbore 12*a*, with liner hanger 218*a* and packer 216*a*. The liner 250 can extend along the wellbore 12*a* as desired. A deflector 252 can be installed proximate the intersection 74 and extend into the upper end of the liner 250 with seals 240*a* providing sealing engagement between the liner 250 and the deflector 252. A liner hanger 218*b* can be used to secure the deflector 252 in a position proximate the intersection 74. However, a latch coupling can be installed in the casing, or other anchoring/orienting devices may be used. The upper end of the deflector 252 can include an inclined surface 254 used to deflect equipment into the lateral wellbore 12*c*. It should be understood that multiple liners can be installed in the wellbore 12*a* between the intersections 74 and 64. It should also be understood that no liners are required to be installed between the intersections 74 and 64. For example, the deflector 252 can be installed with a packer at its lower end to seal off the annulus 58 without a liner 250 being installed.

With the deflector 252 installed, the MIC junction assembly 200 can be installed at the intersection 74. The MIC junction assembly 200 can include a unitary deforming conduit 206 with a primary leg 148 and a lateral leg 150. Similar to the junction assembly 92 described above, the lateral leg 150 can be deflected into the lateral wellbore 12*c* which can cause the lateral leg 150 to deform and separate from the primary leg 148. The lateral leg can include the lower completion assembly 66*c* that can be located in the wellbore 12*c* as the MIC junction assembly 200 is being installed at the intersection 74. However, the lower completion assembly 66*c* can also be installed in wellbore 12*c* prior to the installation of the MIC junction assembly 200, with the MIC junction assembly 200 carrying a stinger 172 (see FIG. 13) at the lower end of the lateral leg 150, where the stinger can engage the lower completion assembly 66*c* to connect the lower completion assembly 66*c* to the MIC junction assembly 200. The primary leg 148 can engage with a PBR in the deflector 252 and provide a sealing engagement via seals 240*b*. The upper portion of the MIC junction assembly 200 can include an upper end 244 (also referred to as end 147) and an upper ETM 214. The MIC junction assembly 200 can be secured in the wellbore 12*a* by a liner hanger 218*c* and packer 216*b*, as well as any other suitable means for securing tubing strings in a wellbore, such as swaging, cementing, etc.

As seen in FIG. 9, a tubing string 30 has been installed in the wellbore 12*a* and extended through the primary leg 148 of the MIC junction assembly 200. Packers 210*a-c* can be used to secure the tubing string 30 within the MIC junction assembly 200 and the liner 250, as well as seal off an annulus formed between the MIC junction assembly 200 and the liner 250. More or fewer seals (e.g. packers 210) can be used, as long as one seal (e.g. packer 210*a*) is positioned below the widow 202, and one seal (e.g. packer 210*b*) is positioned above the window 202, such that fluid flow 230 between the main wellbore 12*a* and the lateral wellbore 12*c* can be controlled. The fluid flow 230 can represent fluids received from multiple wellbore intervals (e.g. intervals 19*a-c* of wellbore 12*c*) that can be co-mingled to form the fluid flow 230. However, it is not a requirement that fluids from multiple intervals be co-mingled to form the fluid flow 230. The multilateral wellbore completion system 10 can control and monitor the various intervals such that fluid from a single interval can form the fluid flow 230. The fluid flow 230 between the tubing string 30 and the lateral wellbore 12*c* can be further controlled by the flow control device 90 that can selectively permit, prevent, and partially prevent fluid flow 230 exiting or entering the tubing string 30.

Figure 10:
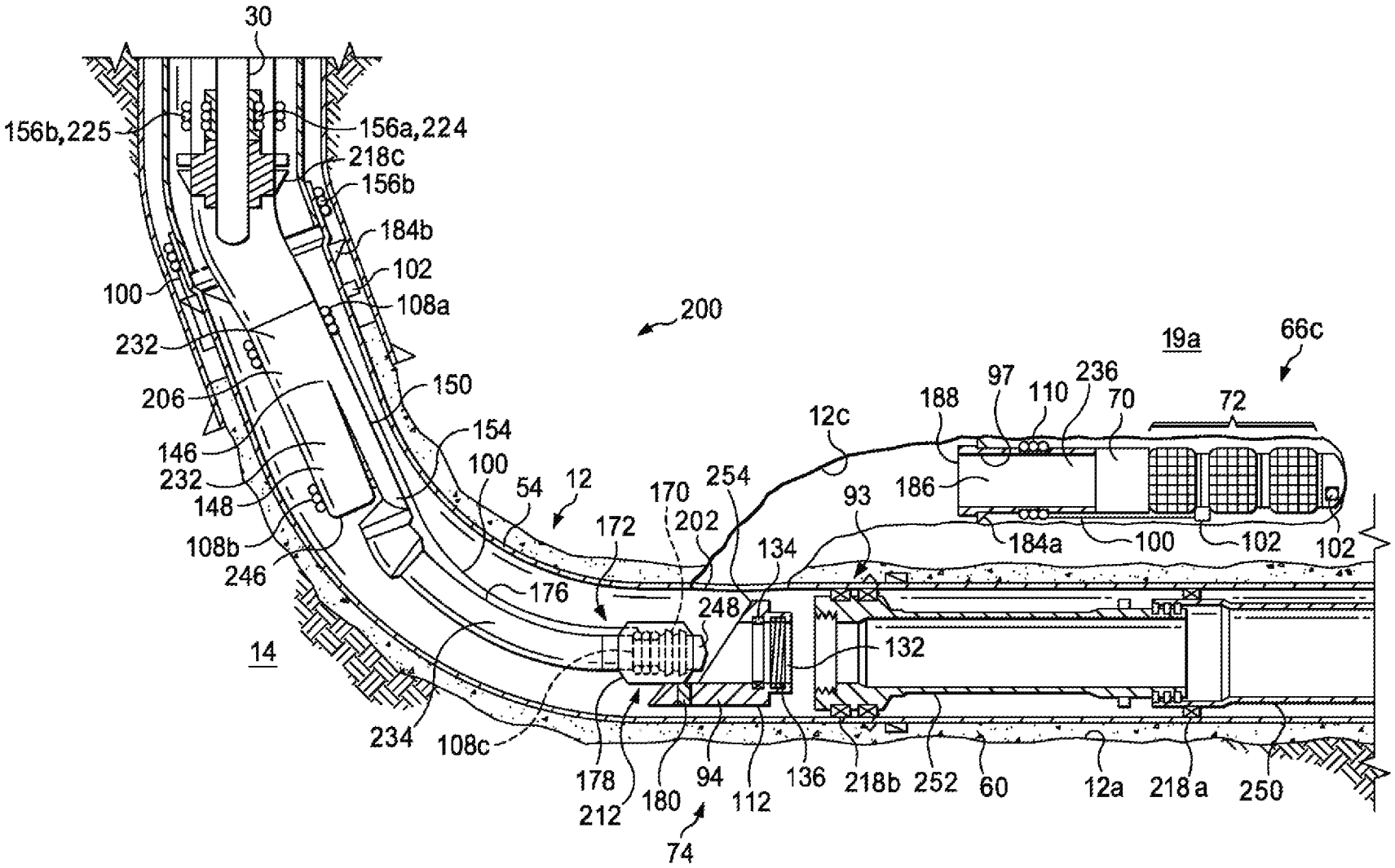
FIG. 10 is a representative partial cross-sectional view of an intersection of a lateral wellbore and a main wellbore prior to installation of a unitary multibranch inflow control (MIC) junction assembly at the intersection, according to one or more example embodiments.
Figure 11:
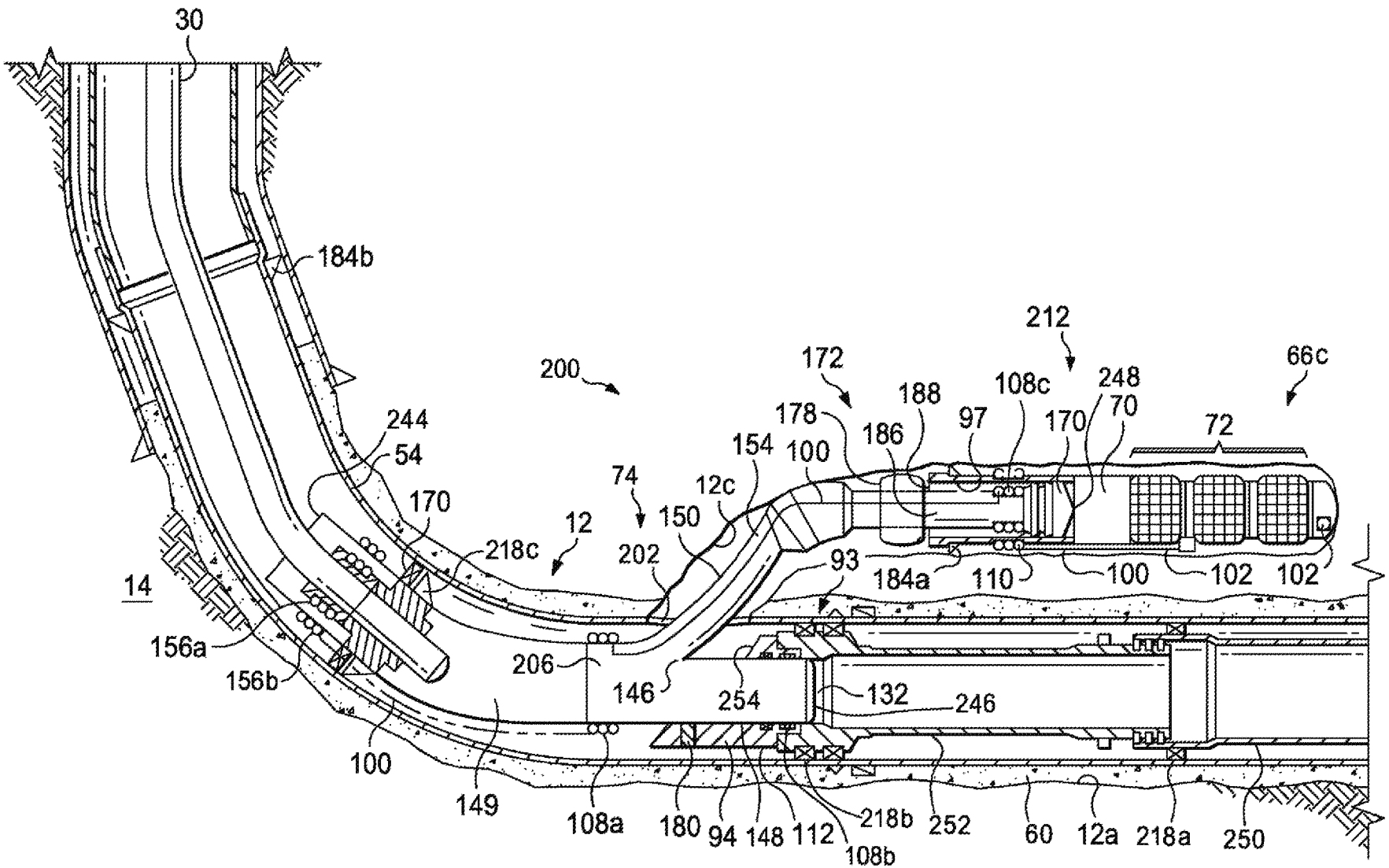
FIG. 11 is a representative partial cross-sectional view of an intersection of a lateral wellbore and a main wellbore after installation of a unitary MIC junction assembly at the intersection, according to one or more example embodiments.
Figure 12:
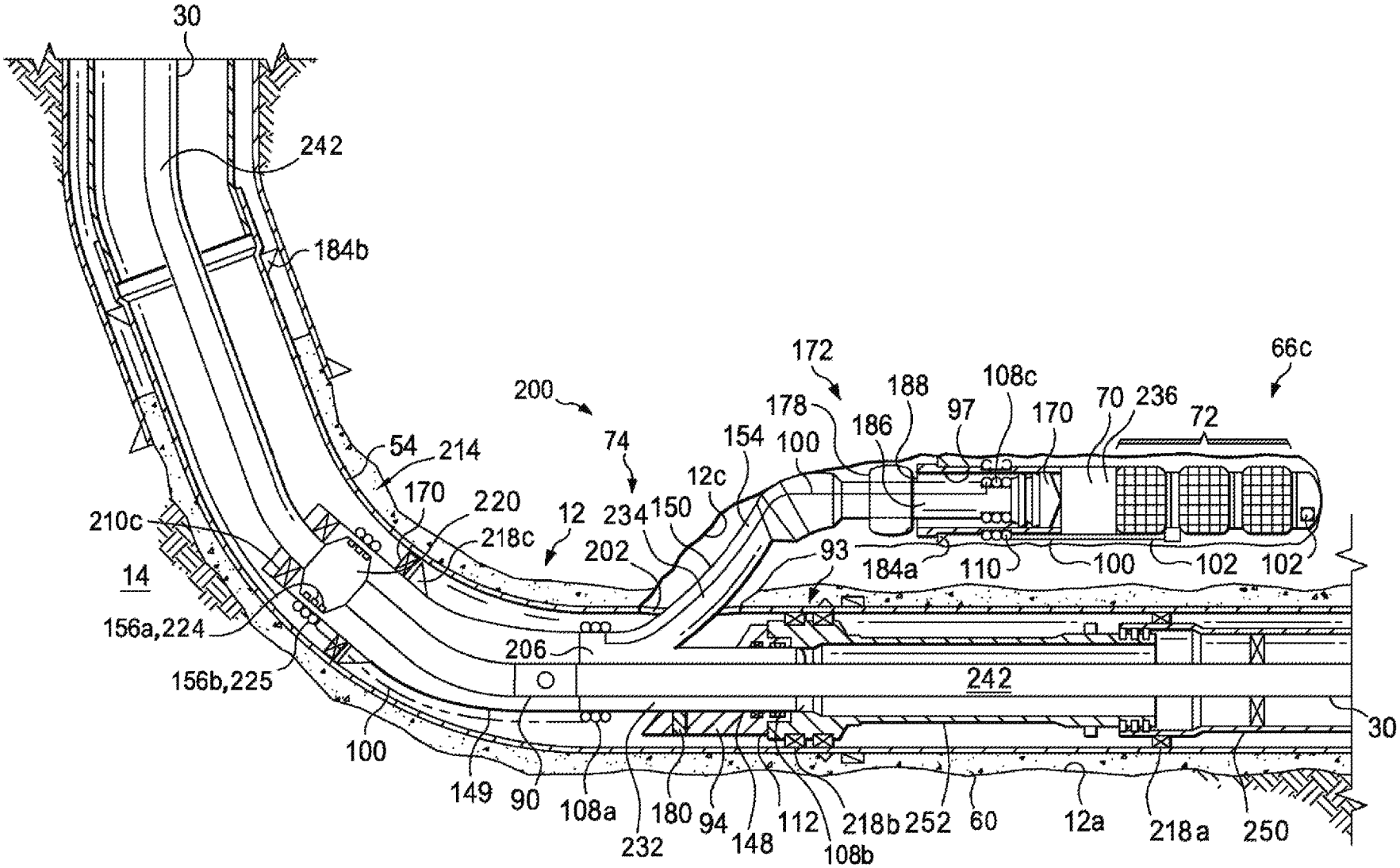
FIG. 12 is a representative partial cross-sectional view of an intersection of a lateral wellbore and a main wellbore after installation of a unitary MIC junction assembly at the intersection and with a tubing string installed through the unitary MIC junction assembly, according to one or more example embodiments.

The ETMs 220, 214 can provide communication between the tubing string 30 and the MIC junction assembly 200, whereas the junction 200 also provides communication with equipment in the lower completion assembly 66*c*, via ETMs 212, 110 (see FIGS. 10-12). Inductive couplers can be used to facilitate the communication between the tubing string 30 and the MIC junction assembly 200, such as hydraulic, optical, and electromagnetic couplers. The ETM 220 can be interconnected in the tubing string 30. When the tubing string 30 is installed in the wellbore 12A and extended through the MIC junction assembly 200, the ETM 220 can align with the ETM 214, where the inductive coupler segments in the ETM 220 (such as the electromagnetic coupler segments 225 and the hydraulic coupler segments 226) align with inductor coupler segments in the MIC junction assembly 200 (such as electromagnetic coupler segments 224 and the hydraulic coupler segments 227, respectively). When these coupler segments are sufficiently aligned, communication can be provided through the ETMs 220, 214 via inductive coupling of the respective segments (224, 225, 226, 227). Regarding the hydraulic coupler segments 226, 227, pairs of adjacent seals 222 can form an annular space 228 between the ETM 220 and the MIC junction assembly 200 and between adjacent hydraulic coupler segments 226 and 227. This allows the hydraulic coupler segments 226 and 227 to be in fluid communication with each other while preventing fluid communication with other annular spaces 228. The hydraulic coupler segments 226 can include control valves which selectively enable and disable fluid communication between the ETMs 220, 214 and the control lines 100 of the MIC junction assembly 200.

Regarding the electromagnetic coupler segments 224, 225, when generally aligned in the MIC junction assembly 200, each respective pair of the electromagnetic coupler segments 224, 225 can communicate via electromagnetic signals with each other. The electromagnetic coupler segments 225 can be connected to control lines 100 for communicating telemetry data (e.g. control and data signals) to/from the lower completion assembly 66*c* equipment and control lines 104 of the tubing string 30. These and other inductive coupling segments can provide communication between control lines 104 and the control lines 100 to facilitate individual communication with operational devices 102 in the lower completion assembly 66*c*, thereby individually controlling fluid flow between the tubing string 30 and the wellbore intervals 19*a-c* and monitoring fluid flow, temperature, pressure, pH, as well as other wellbore parameters.

The ETMs 220, 214 allow the MIC junction assembly 200 to be installed in the wellbore 12*a* at one or more intersections (e.g. intersection 74) before installing a tubing string 30 that extends through the one or more MIC junction assemblies 200 and enables individual control of wellbore intervals (e.g. intervals 19*a-c*) in the lateral wellbore 12*c*. As multiple junctions are utilized, the alignment of coupler segments of the ETMs 220 and 214 becomes more difficult. To alleviate this issue, expansion joints (possibly with intelligent control lines) can be used to allow for variations in the main and lateral wellbores. Also, as stated before, the ETM coupler segments may be "stacked" in series, and/or be extra-long, multi-tap, coupler segments to provide better alignment options. Other components/methods (no-go shoulders, ratch-latches, etc.) can be used to further ensure sufficient alignment of the coupler segments for maximum transfer of power/energy from one coupler segment to another coupler segment, as well as allow the hydraulic transfer units to seal properly for the transfer of pressurized fluid through an ETM.

The MIC junction assembly 200 shown in FIGS. 10 and 11 functions similarly to the junction assembly 92 shown in FIGS. 5 and 6 and described above. In general, FIGS. 5 and 6 show an installation of the junction assembly 92 at an intersection 64 in the wellbore 12*a*. FIGS. 10 and 11 show an installation of a MIC junction assembly 200 at an intersection 74. As the MIC junction assembly 200 is carried through the wellbore 12*a* to the intersection 74, the lateral leg 150 is deflected into the lateral wellbore 12*c* by an inclined surface 254 of the deflector 252. The deflector 252 is shown possibly being carried to the intersection on the MIC junction assembly 200, as similarly explained regarding FIGS. 5 and 6. However it is preferred that the deflector 252 is installed prior to conveyance of the MIC junction assembly 200 in the wellbore 12*a*. The liner 250 can be installed in the wellbore 12*a* and secured with the liner hanger 218*a*. The deflector 252 can be inserted into a PBR at the upper end of the liner 250 and sealingly engage the PBR. The deflector 252 can be secured in the wellbore 12*a* by the liner hanger 218*b* (or other anchoring/orienting devices). It should also be understood, that the lower completion assembly 66*c* can be attached to the lateral leg 150 and run in with the MIC junction assembly 200. The liner hanger 218*c* can be used to secure the MIC junction assembly 200 at the intersection 74. The unitary conduit 206 can include the lateral leg 150 and a primary leg 148. The lateral leg 150 is deflected into the lateral wellbore 12*c* through the window 202.

Referring to FIG. 12, at least one difference between the junction assembly 92 installation and the MIC junction assembly 200 installation is that a tubing string 30 can be extended through the MIC junction assembly 200, whereas the junction assembly 92 does not allow a tubing string 30 to extend therethrough. The work string 30 used to convey the MIC junction assembly 200 to the intersection 74 has been removed and a tubing string 30 has been installed through the MIC junction assembly 200. Packers 210*a*, 210*c* can be used to secure the tubing string 30 within the MIC junction assembly 200, and flow control device 90 can be used to control fluid flow 230 (see FIG. 9) between the tubing string 30 and the lower completion assembly 66*c*. The ETM 220 (with inductive coupler segments 156*a*, in this example) is shown aligned with the inductive coupler segments 156*b* (can also be referred to as ETM 214). This can provide the inductive coupling for communicating with the lower completion assembly equipment 66*c* via the control lines 100. As indicated in FIG. 8, and in more detail in FIG. 12, the tubing string 30 can extend through the primary passageway 232 of the MIC junction assembly 200, and sealing couple with the lower junction assembly 92 at the intersection 64 or another MIC junction assembly 200 at another intersection. This can provide communication between equipment in the upper and lower completion assemblies 86, 66*a-c* to individually control fluid flow between the wellbore intervals 17*a-c*, 18*a-c*, 19*a-c* and the tubing string 30. Telescoping joints can be installed in the tubing string 30 to allow for additional flexibility in aligning the coupler segments in the ETMs.

Figure 13:
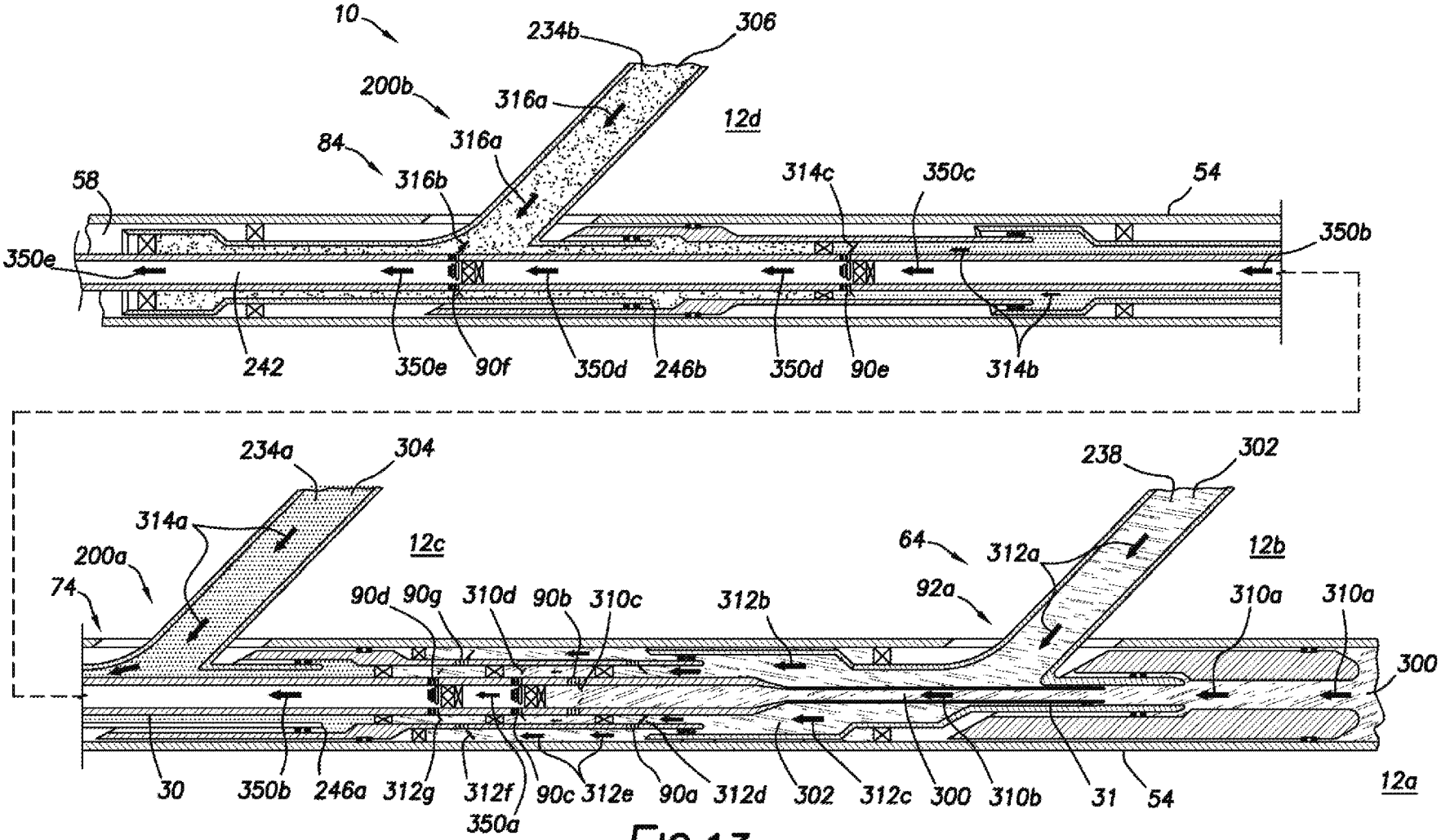
FIG. 13 is a representative partial cross-sectional view of a well completion system having a unitary junction assembly installed at a lower intersection of a lateral wellbore and a main wellbore, and a multibranch inflow control unitary (MIC) junction assembly installed at each of two upper intersections of a lateral wellbore and the main wellbore, according to one or more example embodiments, the view including example fluid flow paths from the laterals to the main wellbore, according to one or more example embodiments.
Figure 14:
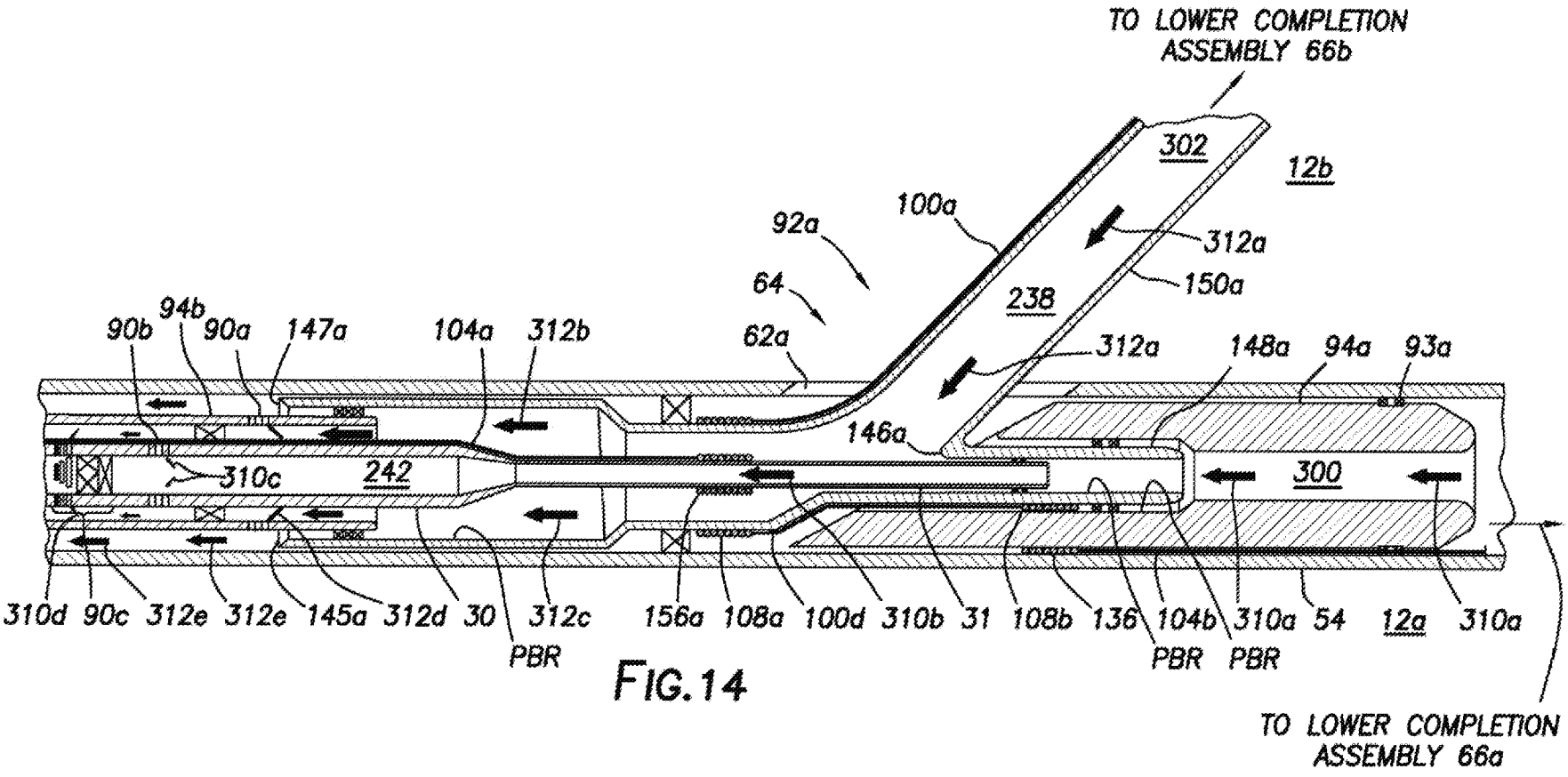
FIG. 14 is a representative partial cross-sectional view of multibranch inflow control unitary (MIC) junction assembly installed at a lowermost intersection of a lateral wellbore and the main wellbore of FIG. 13, according to one or more example embodiments, the view including example fluid flow paths from the lateral to the main wellbore, according to one or more example embodiments.
Figure 15:
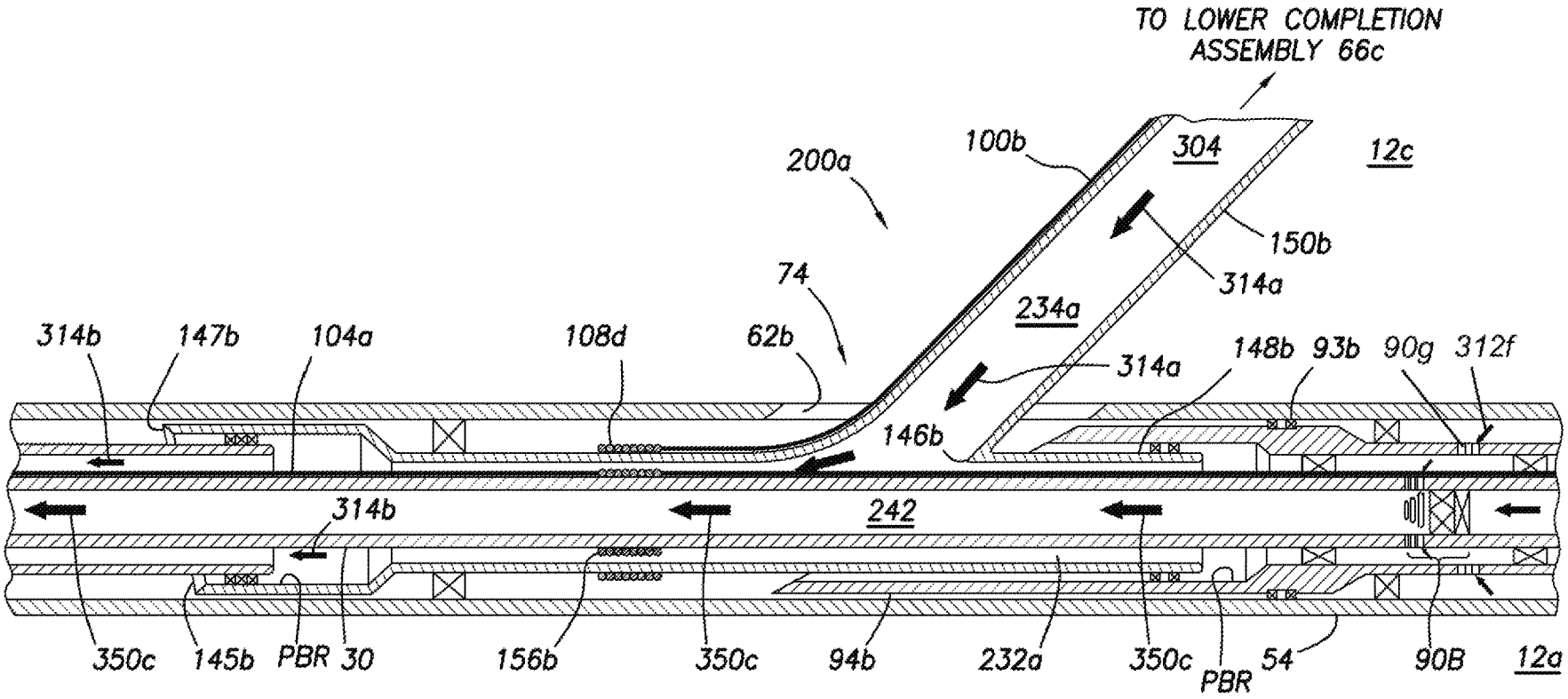
FIG. 15 is a representative partial cross-sectional view of multibranch inflow control unitary (MIC) junction assembly installed at an intermediate intersection of a lateral wellbore and the main wellbore of FIG. 13, according to one or more example embodiments, the view including example fluid flow paths from the lateral to the main wellbore, according to one or more example embodiments.
Figure 16:
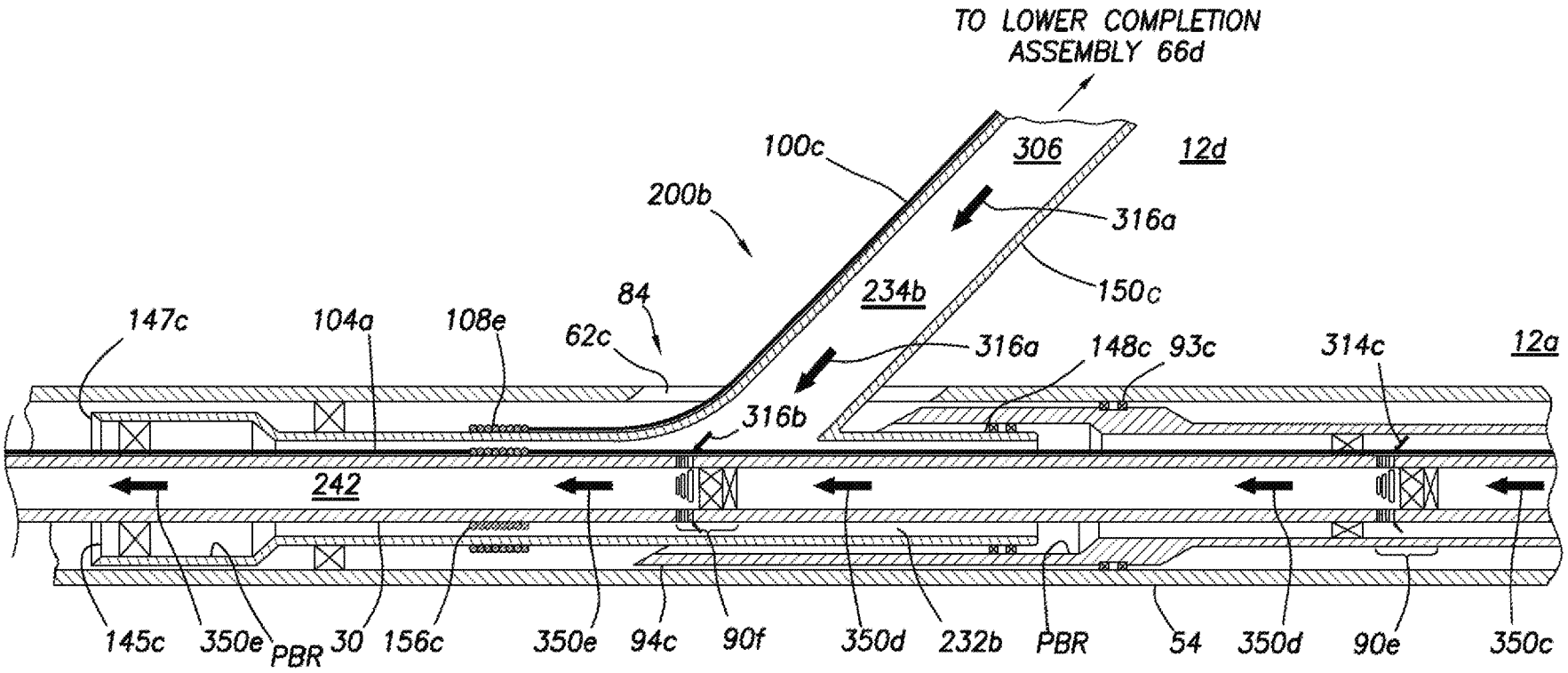
FIG. 16 is a representative partial cross-sectional view of a junction assembly installed at an uppermost intersection of a lateral wellbore and the main wellbore of FIG. 13, according to one or more example embodiments, the view including example fluid flow paths from the lateral to the main wellbore, according to one or more example embodiments.

Referring to FIGS. 13-16, a partial cross-sectional view of another multilateral wellbore system 10 is shown, with FIG. 13 being an overview and FIGS. 14-16 being detailed views of separate portions of FIG. 13. FIG. 13 shows completion equipment installed in the wellbore system 10 to support completion operations, such as treatment, injection, and production operations. FIG. 14 shows a detailed partial cross-sectional view of completion equipment installed at an intersection 64 of lateral wellbore 12*b* and main wellbore 12*a*. FIG. 15 shows a detailed partial cross-sectional view of completion equipment installed at an intersection 74 of lateral wellbore 12*c* and main wellbore 12*a*. FIG. 16 shows a detailed partial cross-sectional view of completion equipment installed at an intersection 84 of lateral wellbore 12*d* and main wellbore 12*a*.

A junction assembly 92*a* can be installed at an intersection 64 with its primary leg 148*a* extended into a deflector 94*a* in the main wellbore 12*a*, and it lateral leg 150*a* extended in to the lateral wellbore 12*b*. A unitary MIC junction assembly 200*a* can be installed at an intersection 74, which is uphole from the intersection 64. Its primary leg 148*b* can be extended into a deflector 94*b* in the main wellbore 12*a*, and its lateral leg 150*b* extended in to the lateral wellbore 12*c*. Another unitary MIC junction assembly 200*b* can be installed at an intersection 84, which is uphole from the intersections 64, 74. Its primary leg 148*c* can be extended into a deflector 94*c* in the main wellbore 12*a*, and its lateral leg 150*c* extended into the lateral wellbore 12*d*. After assembly of the completion equipment in the wellbore system 10 as shown in FIG. 13, a tubing string 30 can be extended from a remote location (such as the surface) through the unitary MIC junction assembly 200*b*, through the unitary MIC junction assembly 200*a*, with a distal end 31 of the tubing string 30 landing in the primary leg 148*a* of the junction assembly 92*a*.

The following discussion will describe fluid flow in the wellbore system 10 as it may relate to a production operation. However, if should be understood that the completion equipment in FIG. 13 can also be used to support other completion operations, such as treatment and injection operations. To support these other operations, the fluid flows can be reversed to flow fluid from the surface (or a remote location in the wellbore 12*a*) into the lower portions of the main wellbore 12*a* and into one or more of the lateral wellbores 12*b*, 12*c*, 12*d*. The flow of fluids in either direction in the wellbore system 10 can be controlled by flow control devices 90*a-f* (as well as additional flow control devices), which can be controlled by a processing device via communication to the completion equipment in the wellbores 12*a*, 12*b*, 12*c*, 12*d* through control lines 100, 104 and ETMs as necessary, thereby controlling flow of fluids from/to any one or more of intervals 17*a-c*, 18*a-c*, 19*a-c* (as well as other intervals, when additional lateral wellbores are completed).

In a production operation, fluid 300 can flow (arrows 310*a*) from lower completion assembly equipment 66*a* in wellbore 12*a* into the distal end 31 of the tubing string 30 becoming fluid flow 310*b* in passageway 242. Fluid 300 can flow through a flow control device 90*b* as fluid flow 310*c* into an annular space outside of the tubing string 30 and then back into the passageway 242 as fluid flow 310*d* through a flow control device 90*c*. The flow control device 90*c* (as well as other flow control devices) can be used to control the amount of fluid 300 that enters the passageway 242 from the lower completion equipment 66*a* and can at least contribute to the fluid flow 350*a-e* that can travel through the tubing string 30 to the surface. It should also be clear that operational devices 102 in the lower completion assembly 66*a* can control fluid flow from individual intervals 17*a-c*.

The fluid 302 can flow (arrows 312*a*) through passageway 238 from the lower completion assembly equipment 66*b* in wellbore 12*b* into an annular space outside the tubing string 30 becoming fluid flow 312*b* and 312*c*. The fluid 302 can flow (arrows 312*d*) radially outward through the flow control device 90*a* into another annular space, becoming fluid flow 312*e*. The fluid 302 can then flow (arrows 312*f*) through a flow control device 90*g*, into yet another annular space and then through a flow control device 90*d* (arrows 312*g*) into the passageway 242. Therefore, any of the flow control devices 90*a*, 90*g*, and 90*d* can be used to control what amount (if any) of fluid 302 that is allowed to enter the passageway 242 from the lower completion equipment 66*b* in the lateral wellbore 12*b* and can at least contribute to the fluid flow 350*b-e* that can travel through the tubing string 30 to the surface.

The fluid 304 can flow (arrows 314*a*) through passageway 234*a* from the lower completion assembly equipment 66*c* in wellbore 12*c* into an annular space outside the tubing string 30 becoming fluid flow 314*b*. The fluid 304 can then flow from the annular space as fluid flow 314*c* into the passageway 242. Therefore, the flow control device 90*e* can be used to control what amount (if any) of fluid 304 that is allowed to enter the passageway 242 from the lower completion equipment 66*c* in the lateral wellbore 12*c* and at least contribute to the fluid flow 350*d-e* that can travel through the tubing string 30 to the surface.

The fluid 306 can flow (arrows 316*a*) through passageway 234*b* from the lower completion assembly equipment 66*d* in wellbore 12*d* into an annular space outside the tubing string 30. The fluid 306 can then flow from the annular space as fluid flow 316*b* through flow control device 90*f* into the passageway 242, and at least contribute to the fluid flow 350*e* that can travel through the tubing string 30 to the surface. Therefore, the flow control device 90*f* can be used to control what amount (if any) of fluid 306 that is allowed to enter the passageway 242 from the lower completion equipment 66*d* in the lateral wellbore 12*d*.

Therefore, as illustrated in FIG. 13, the fluid produced from (or injected into) the wellbores 12*a*, 12*b*, 12*c*, 12*d* can be controlled with the flow control devices 90*a-g* in this example configuration of completion equipment in the wellbore system 10. The flow control devices 90*a-g* (as well as others, if needed) can be controlled via power, control, and data signals communicated to the control devices 90*a-g* via control lines and EMTs. The junction assembly 92*a* and the unitary MIC junction assemblies 200*a*, 200*b*, in this example, can provide paths to carry communication signals between the completion equipment, including the flow control devices 90*a-g*, thereby allowing control of fluid flow between surface equipment and each wellbore 12*a*, 12*b*, 12*c*, 12*d*, as well as individually controlling fluid flow from individual formation intervals along the wellbores 12*a*, 12*b*, 12*c*, 12*d*. It should also be clear, as mentioned previously, that these flow control devices 90*a-g* (as well as fewer or more flow control devices) can be used to control injection of fluids into individual intervals in the main wellbore and lateral wellbores when the wellbore system is used in injection or treatment operations.

FIG. 14 shows a more detailed partial cross-sectional view of the intersection 64 of FIG. 13. A deflector 94*a*, with an orientation device 93*a*, can be installed proximate the window 62*a* in the casing 54. The junction assembly 92*a* can be installed at the intersection 64, where the primary leg 148*a* sealingly engages a polished bore receptacle (PBR) in the deflector 94*a*, and the lateral leg 150*a* sealingly couples to the lower completion assembly 66*b* (not shown). A distal end of another deflector 94*b* can extend into the aperture 145*a* and sealingly engage a PBR in the upper portion of the junction assembly 92*a*. The tubing string 30 can be installed through the deflector 94*b* with its distal end 31 sealingly engaging a PBR in the primary leg 148*a* of the junction assembly 92*a*.

Control lines 104*a* can extend along the tubing string 30 to connect the surface equipment (not shown) to the coupler segments 156*a-c* along the tubing string 30. It should be understood that any number of coupler segments can be used along the tubing string 30. In FIG. 14, the control lines 104*a* connect to the coupler segments 156*a* which can be axially aligned with the coupler segments 108*a* disposed on an exterior of the junction assembly 92*a*. It should be understood that the positions of the coupler segments in FIGS. 13-16 are merely examples of locations for these items. They can be at many other positions, as long as the alignment of the coupler segments in an ETM provide for energy transfer between the coupler segments (such as 156*a* and 108*a*). The ETM preferably consists of source and destination coupler segments, with either coupler segment in the ETM capable of being a source or destination as well as switching between source and destination during operations.

Control lines 100*a* can be connected between the coupler segments 108*a* and the lower completion assembly 66*b* equipment in the lateral wellbore 12*b*. Therefore, communication through the coupler segments 156*a* and 108*a* can be used to control the lower completion assembly 66*b* equipment. Control lines 100*d* can be connected between the coupler segments 108*a* and 108*b* to enable communication between these coupler segments. The coupler segments 108*b* can be aligned with coupler segments 136 to enable energy transfers between the coupler segments 108*b* and 136. The coupler segments 136 can be connected to the lower completion assembly 66*a* equipment in the main wellbore 12*a* via control lines 104*b*, thereby enabling control of the lower completion assembly 66*a* equipment. The communication paths provided by the control lines and the coupler segments enable control of the lower assembly equipment in the wellbores 12*a*, 12*b* as well as other operational devices (such as flow control devices 90*a-g*) to control fluid flow between the wellbores 12*a*, 12*b* and the passageway 242 of the tubing string 30. Please refer to the discussion above regarding the fluid flow arrows 310*a-d* and 312*a-e*.

FIG. 15 shows a more detailed partial cross-sectional view of the intersection 74 of FIG. 13. A deflector 94*b*, with orientation device 93*b*, can be installed proximate the window 62*b* in the casing 54. The unitary MIC junction assembly 200*a* can be installed at the intersection 74, where the primary leg 148*b* sealingly engages a PBR in the deflector 94*b*, and the lateral leg 150*b* sealingly couples with the lower completion assembly 66*c* (not shown). A distal end of another deflector 94*c* can extend into the aperture 145*b* and sealingly engage a PBR in the upper portion of the unitary MIC junction assembly 200*a*. The tubing string 30 can be installed through the deflector 94*c*, through primary passageway 232*a* of the unitary MIC junction assembly 200*a*, and through the deflector 94*b* to land the distal end 31 in the junction assembly 92*a*.

Control lines 104*a* can extend along the tubing string 30 to connect the surface equipment (not shown) to the coupler segments 156*a-c* along the tubing string 30. In FIG. 15, the control lines 104*a* connect to the coupler segments 156*b* which can be axially aligned with the coupler segments 108*d* disposed on an exterior of the unitary MIC junction assembly 200*a*. The control lines 100*b* can be connected between the coupler segments 108*d* and the lower completion assembly 66*c* equipment in the lateral wellbore 12*c*. Therefore, communication through the coupler segments 156*b* and 108*d* can be used to control the lower completion assembly 66*c* equipment. The communication paths provided by the control lines and the coupler segments enable control of the lower assembly equipment in the wellbores 12*a*, 12*b*, 12*c* as well as other operational devices (such as flow control devices 90*a-g*) to control fluid flow between the individual intervals in each of the wellbores 12*a*, 12*b*, 12*c* and the passageway 242 of the tubing string 30. Please refer to the discussion above regarding the fluid flow arrows 314*a* and 350*c*.

FIG. 16 shows a more detailed partial cross-sectional view of the intersection 84 of FIG. 13. A deflector 94*c*, with orientation device 93*c*, can be installed proximate the window 62*c* in the casing 54. The unitary MIC junction assembly 200*b* can be installed at the intersection 84, where the primary leg 148*c* sealingly engages a PBR in the deflector 94*c*, and the lateral leg 150*c* sealingly couples with the lower completion assembly 66*d* (not shown). The end 147*c* of the unitary MIC junction assembly 200*b* can be flared or otherwise configured to assist insertion of the tubing string 30 into the primary passageway 232*b*. The tubing string 30 can be installed through the aperture 145*c*, through primary passageway 232*b* of the unitary MIC junction assembly 200*b*, and through the deflector 94*c* and can be further extended through the unitary MIC junction assembly 200*a* to land the distal end 31 in a proximal end of the junction assembly 92*a*.

Control lines 104*a* can extend along the tubing string 30 to connect the surface equipment (not shown) to the coupler segments 156*a-c* along the tubing string 30. In FIG. 16, the control lines 104*a* connect to the coupler segments 156*c* which can be axially aligned with the coupler segments 108*e* disposed on an exterior of the unitary MIC junction assembly 200*b*. The control lines 100*c* can be connected between the coupler segments 108*e* and the lower completion assembly 66*d* equipment in the lateral wellbore 12*d*. Therefore, communication through the coupler segments 156*c* and 108*e* can be used to control the lower completion assembly 66*d* equipment. The communication paths provided by the control lines and the coupler segments enable control of the lower assembly equipment in the wellbores 12*a*, 12*b*, 12*c*, 12*d* as well as other operational devices (such as flow control devices 90*a-g*) to control fluid flow between the individual intervals in each of the wellbores 12*a*, 12*b*, 12*c*, 12*d* and the passageway 242 of the tubing string 30. Please refer to the discussion above regarding the fluid flow arrows 316*a-b* and 350*d-e*.

Figure 17:
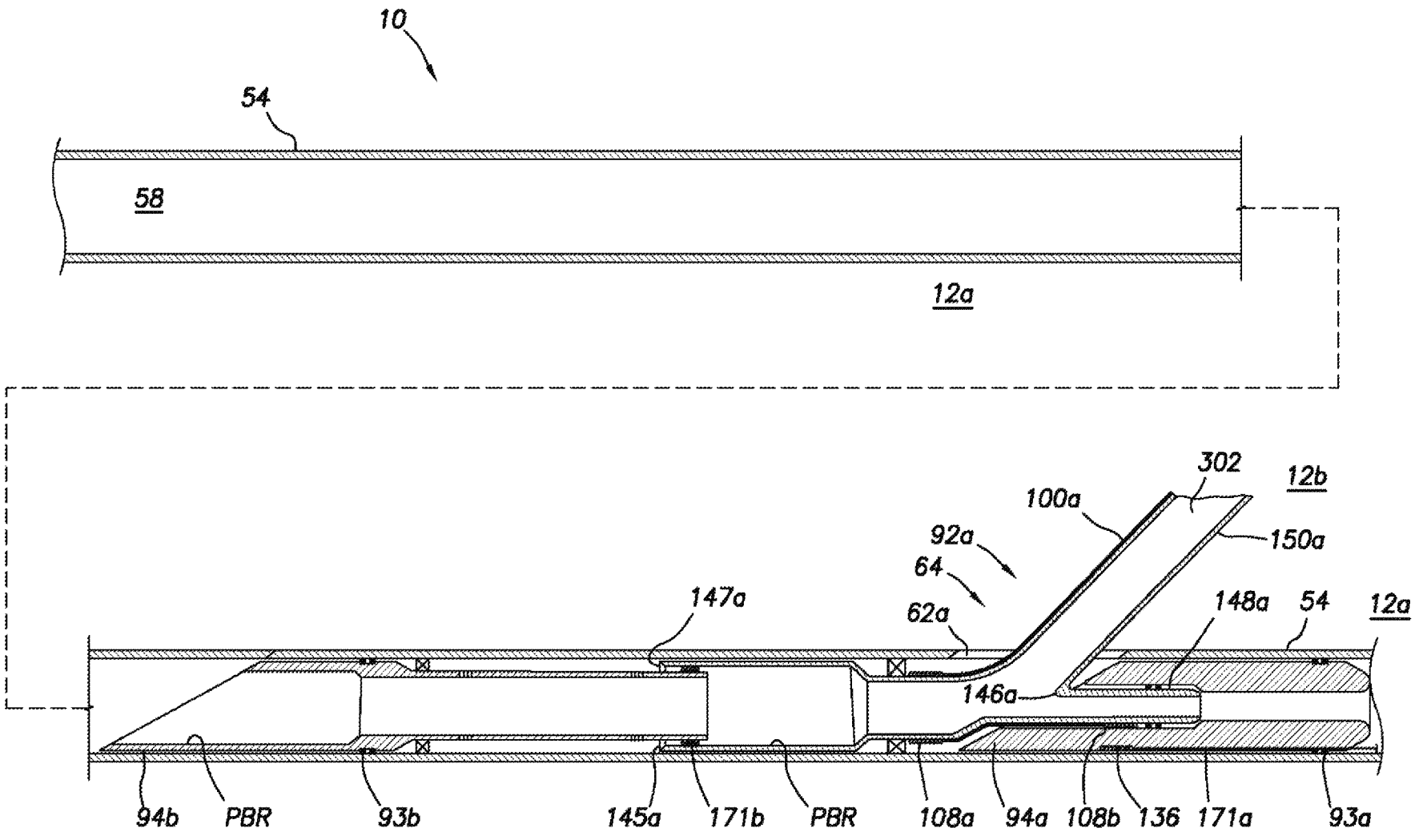
FIG. 17-19 are representative partial cross-sectional views of the offshore well completion system of FIG. 13 at various stages of installation of the junction assemblies at the intersections of the lateral wellbores and the main wellbore, according to one or more example embodiments.
Figure 18:
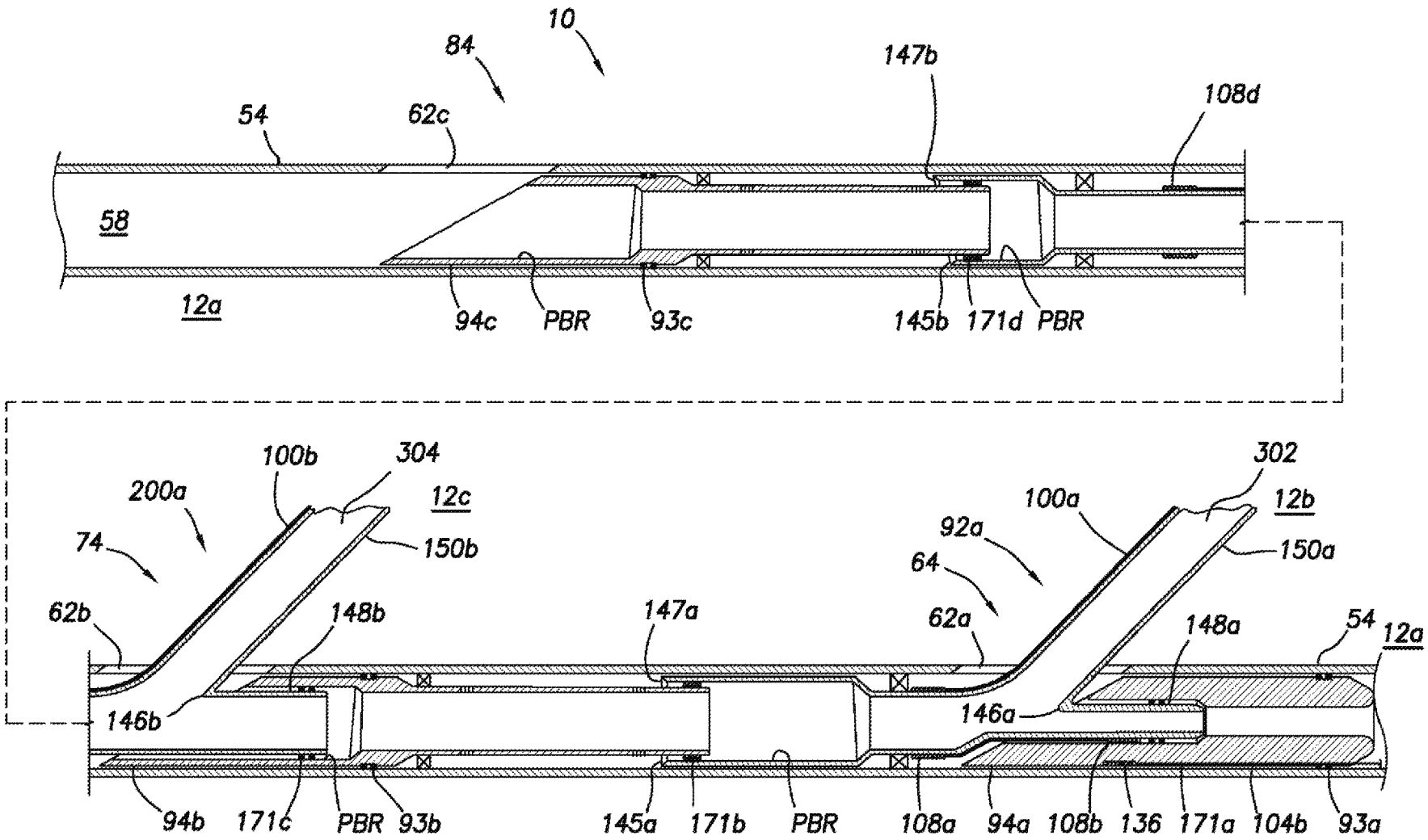
Figure 19:
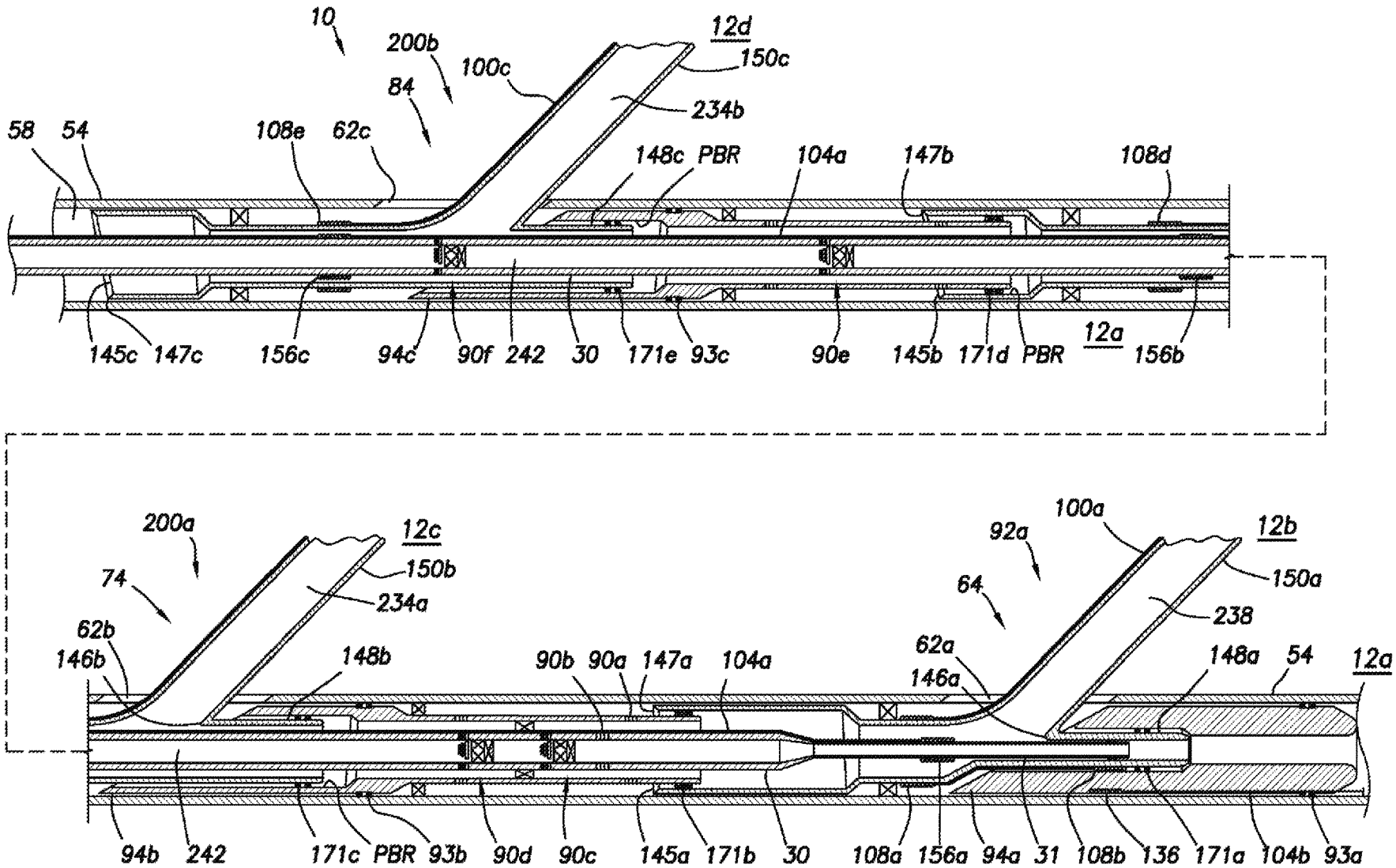

FIGS. 17-19 show partial cross-sectional views of the wellbore system 10 in various stages of assembly of completion equipment within the multi-lateral wellbore system 10. The earthen formation 14 surrounding the wellbores is not shown to more easily view the wellbore equipment.

FIG. 17 shows a casing 54 that has been secured in a main wellbore 12*a*. A first lateral wellbore 12*b* has been drilled through the wall of the casing 54 to form the window 62*a*. After the lateral wellbore 12*b* has been drilled, a deflector 94*a* can be secured in the wellbore 12*a* via the orientation device 93*a*. The junction assembly 92*a* can then be installed in the wellbore 12*a* at the intersection 64, with the primary leg 148*a* extended into the deflector 94*a* and sealingly engaged with a PBR in the deflector 94*a* by seals 171*a*. The lateral leg 150*a* can be extended into the lateral wellbore 12*b*. Even though it is not shown, the lateral leg 150*a* can be coupled to the lower completion assembly 66*b* equipment in the lateral wellbore 12*b*, including coupling the control lines 100*a* to the lower completion assembly 66*b* equipment. One or more liner strings (not shown) can then be installed in the wellbore 12*a*, with the distal end of the lowermost liner string sealingly engaged via seals 171*b* with the PBR extending downhole from the end 147*a*. However, FIG. 17 shows the deflector 94*b* installed in the wellbore 12*a* and extending into sealing engagement with the PBR via seals 171*b*. In this example, the remaining two lateral wellbores 12*c*, 12*d* have not yet been drilled.

FIG. 18 shows a unitary MIC junction assembly 200*a* installed in the wellbore 12*a* at the intersection 74 after the lateral wellbore 12*c* has been drilled through the window 62*b*. The primary leg 148*b* can be sealingly engaged with the PBR of deflector 94*b* via seals 171*c*. The lateral leg 150*b* can be extended into the lateral wellbore 12*c*. Even though it is not shown, the lateral leg 150*b* can be coupled to the lower completion assembly 66*c* equipment in the lateral wellbore 12*c*, including coupling the control lines 100*b* to the lower completion assembly 66*c* equipment. One or more liner strings (not shown) can then be installed in the wellbore 12*a*, with the distal end of the lowermost liner string sealingly engaged via seals 171*d* with the PBR extending from the end 147*b*. However, FIG. 18 shows a deflector 94*c* installed in the wellbore 12*a* and extending into sealing engagement with the PBR via seals 171*d*.

FIG. 19 shows a unitary MIC junction assembly 200*b* installed in the wellbore 12*a* at the intersection 84 after the lateral wellbore 12*d* has been drilled through the window 62*c*. The primary leg 148*c* can be sealingly engaged with the PBR of deflector 94*c* via seals 171*e*. The lateral leg 150*c* can be extended into the lateral wellbore 12*d*. Even though it is not shown, the lateral leg 150*c* can be coupled to the lower completion assembly 66*d* equipment in the lateral wellbore 12*d*, with the control lines 100*b* being coupled to the lower completion assembly 66*d* equipment. A tubing string 30 (such as a production string, treatment string, injection string, etc.) has been installed in the wellbore 12*a* and is extended through the unitary MIC junction assembly 200*b*, and through the unitary MIC junction assembly 200*a*, with the distal end 31 engaged with the junction assembly 92*a*. This example illustrates at least one configuration of the unitary MIC junction assemblies that can support completion operations in multi-lateral wellbore systems like the system 10.

Figure 20:
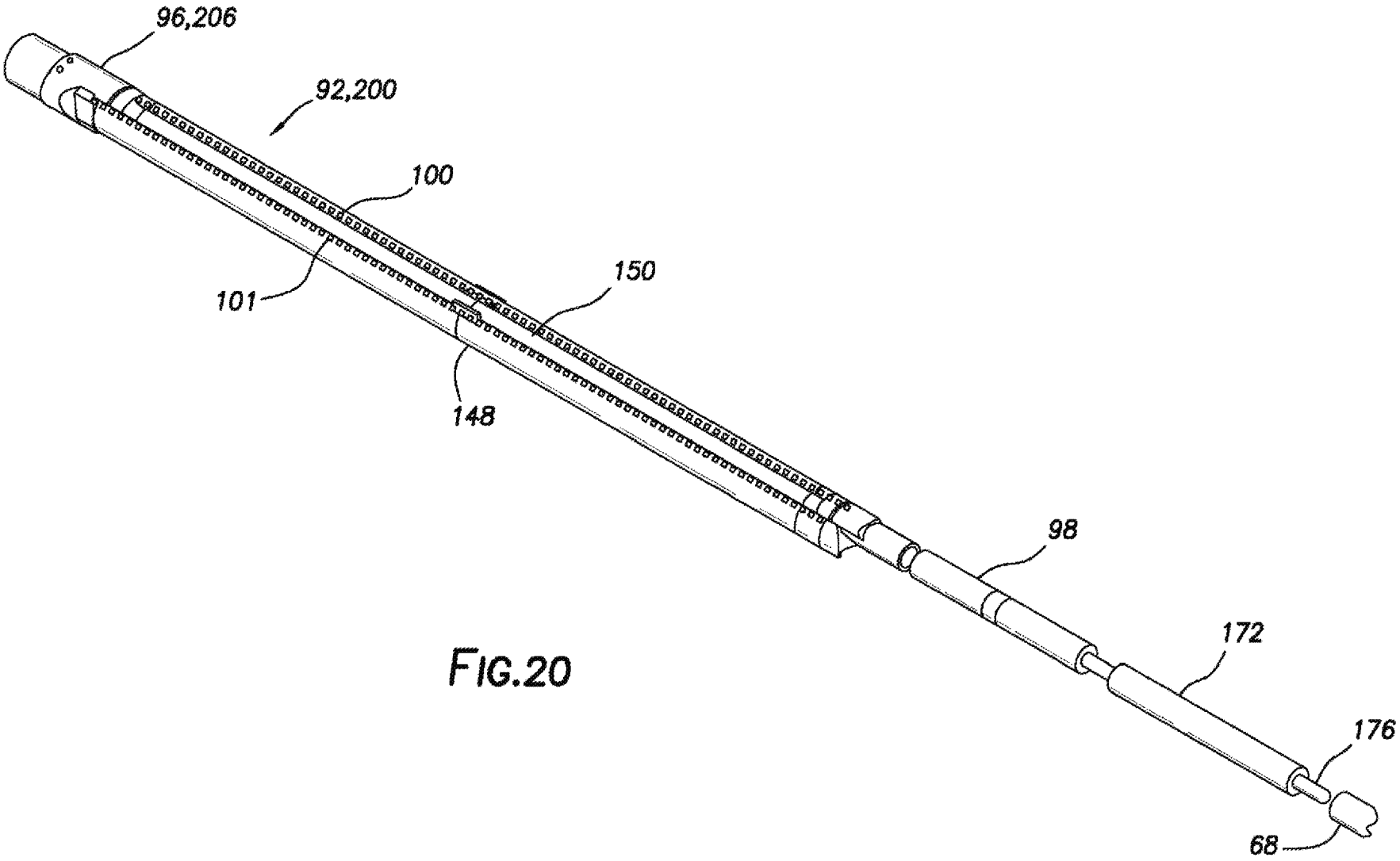
FIG. 20 is a representative perspective view of a unitary MIC junction assembly shown separate for clarity prior to a lateral leg engaging a deflector at an intersection, with other components connected to the lateral leg of the unitary MIC junction assembly, according to one or more example embodiments.

Referring to FIG. 20, another example is shown of the unitary conduits 96, 206 of the junction assembly 92 and the MIC junction assembly 200, respectively. The unitary conduits 96, 206 can each include a primary leg 148, lateral leg 150, and control lines 100, 101. The control lines 100 are shown routed along the lateral leg 150 to communicate with a lower completion assembly 66*b*, 66*c*, 66*d* in a lateral wellbore 12*b*, 12*c*, 12*d*, respectively. However, they can be routed on the outside or inside of the lateral leg 150, as well as partially or fully in the wall of the lateral leg 150. For the junction assembly 92, the control lines 101 can be routed along the primary leg 148 to provide communication to the completion assembly equipment positioned below the primary leg 148. However, control lines 101 may not be necessary with the MIC junction assembly 200, since the tubing string 30 can carry control lines for communicating to the lowest lower completion assemblies 66*a*, 66*b*.

The lateral leg 150 can be disposed in a somewhat circular indention in the primary leg 148 to be run in to the wellbore 12*a*. When the lower end of the lateral leg 150 engages a deflector, then the lateral leg 150 can be directed away from the primary leg 148 and into the lateral wellbore 12*b*, 12*c*, 12*d*. A stinger 172 can be assembled to the lower end of the lateral leg 150 for engaging an alignment subassembly 68 in the lower completion assembly 66 in a lateral wellbore. A stinger member 176 can be used to assist with proper engagement of the alignment subassembly 68 when the lateral leg 150 is extended into the lateral wellbore. Some configurations may utilize a telescoping joint 98 between the lateral leg 150 and the stinger 172 to allow for variations in the insertion distances between the primary leg 148 and the lateral leg 150.

Figure 21:
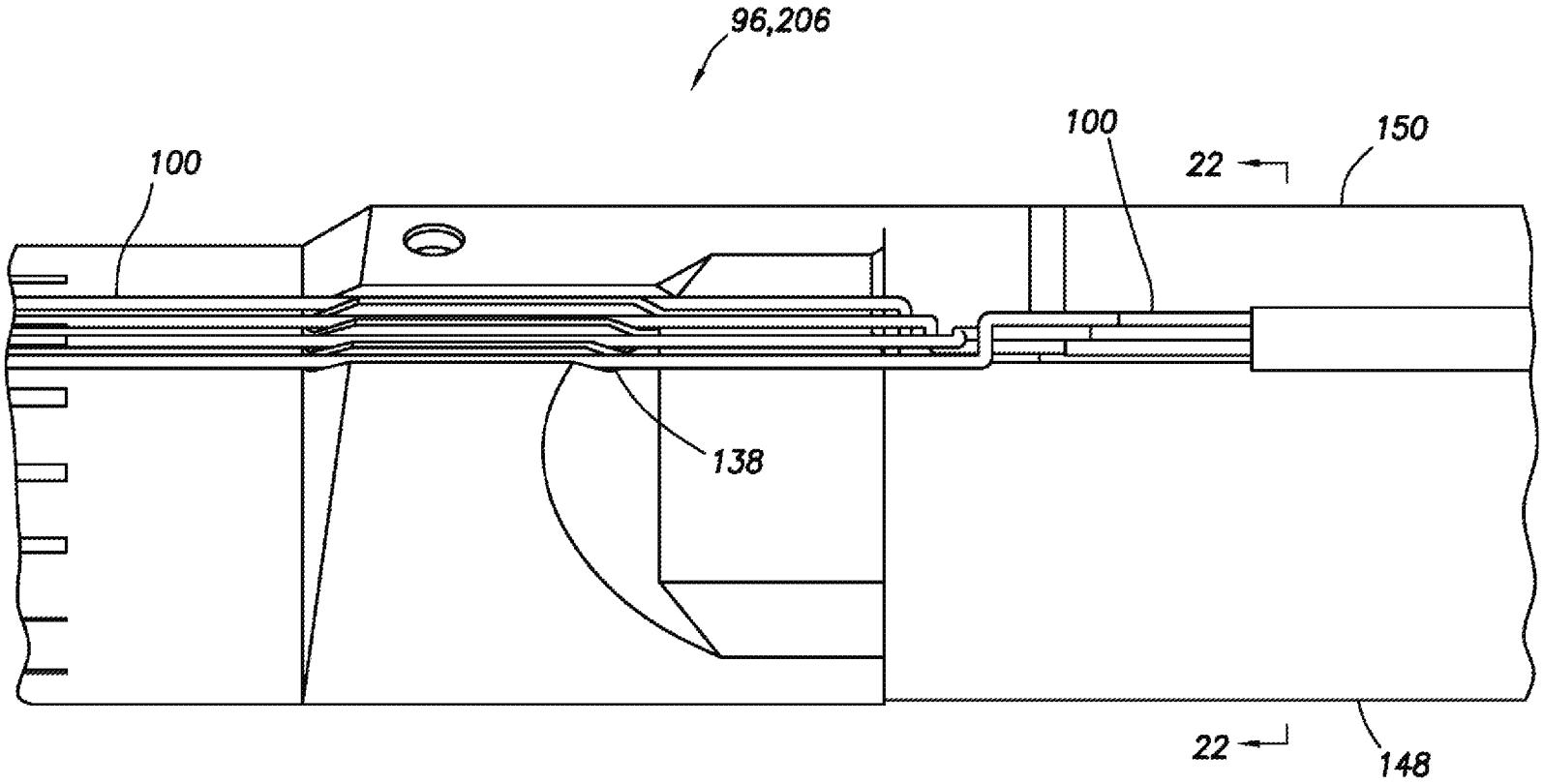
FIG. 21 is a representative partial side view of a unitary MIC junction assembly with example control line routing, according to one or more example embodiments.

Referring to FIG. 21, the control lines 100 may be routed through channels 138 in an exterior surface of a body of the unitary conduit 96, 206. The control lines 100 can be routed from the inductive coupling segments 156, 108, through the channels 138 and along the lateral leg 150 to the lower completion assembly (e.g. assembly 66*c*). The control lines 100 can be individually routed lines, and/or line assemblies that contain two or more control lines 100.

Figure 22:
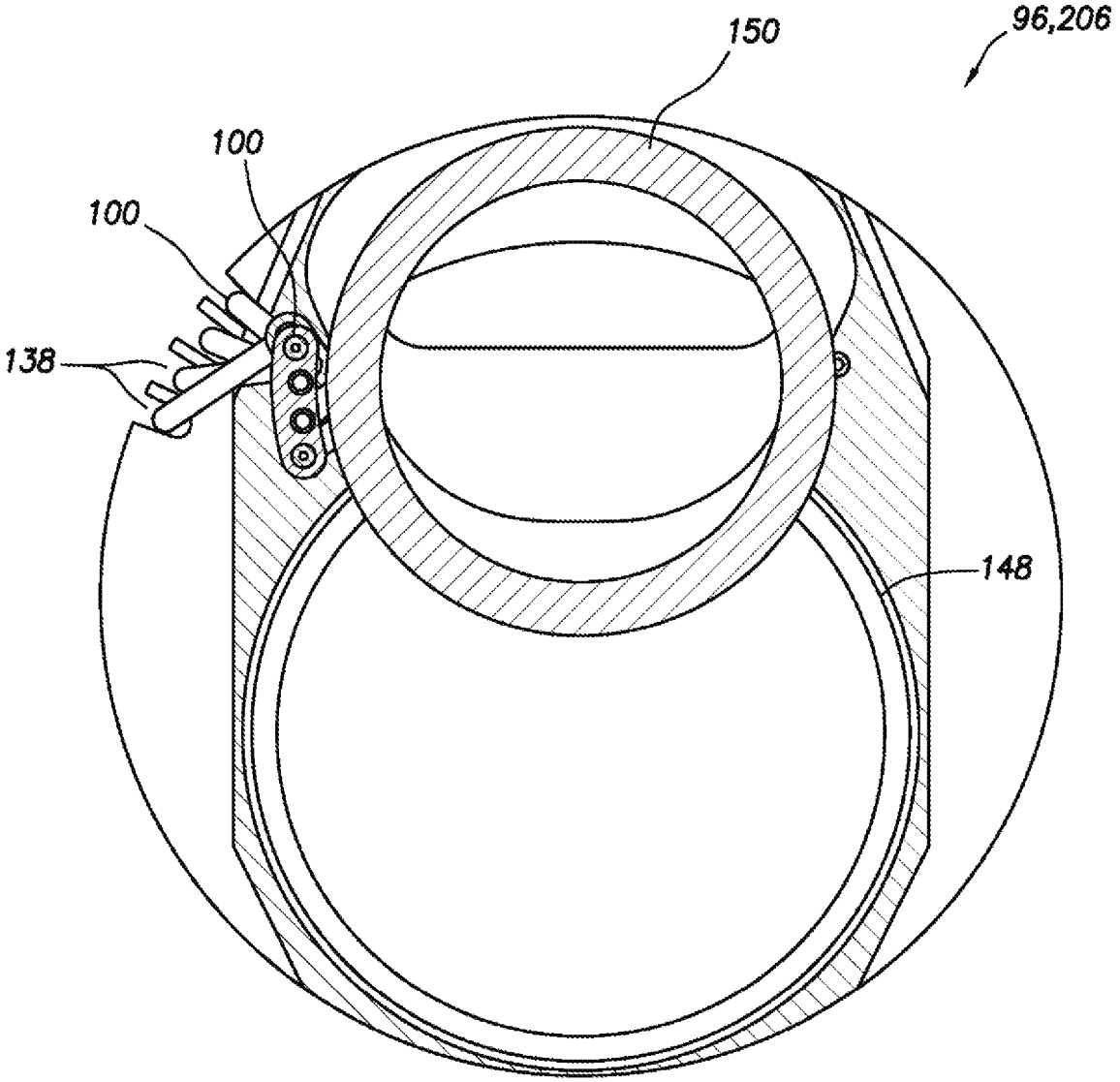
FIG. 22 is a representative cross-sectional view of the unitary MIC junction assembly of FIG. 21, according to one or more example embodiments.

Referring to FIG. 22, a cross sectional view along 22-22 is shown, with the control lines 100 positioned within the channels 138, four channels 100 grouped together in a 4-channel assembly, and the lateral leg 150 positioned in a somewhat circular recess of the primary leg 148. For this configuration to be compatible with the unitary conduit 206 of the MIC junction assembly 200, the primary leg 148 must be large enough to accommodate the somewhat circular (or semi-circular) recess and maintain an inner diameter that allows a tubing string to pass through the primary leg 148 when it's installed.

Thus, a multilateral wellbore system 10 system with a multibranch inflow control (MIC) junction assembly is provided. Embodiments of the system may generally include a unitary MIC junction assembly 200 having a conduit 206 with a first aperture 190 at an upper end 244 of the conduit 206, and second and third apertures 192, 194 at a lower end 246, 248 of the conduit 206; a primary passageway 232 formed by the conduit 206 and extending from the first aperture 190 to the second aperture 192 with a conduit junction 146 defined along the conduit 206 between the first and second apertures 190, 192, the primary passageway 232 comprising an upper portion and a lower portion with the upper portion extending from the first aperture 190 to the conduit junction 146, and the lower portion extending from the conduit junction 146 to the second aperture 192; a lateral passageway 234 formed by the conduit 206 and extending from the conduit junction 146 to the third aperture 194; an upper energy transfer mechanism (ETM) 214 mounted along the upper portion of the primary passageway 232 and proximate the first aperture 190; control lines 100 that provide communication between the upper ETM 214 and lower completion assembly 66*c*, 66*d* equipment (48, 102, 99*a-g*, etc.); and the primary passageway 232 is configured to receive a first tubing string 30 that extends therethrough.

For any of the foregoing embodiments, the system may include any one of the following elements, alone or in combination with each other:

A lower energy transfer mechanism (ETM) 212 mounted along the lateral passageway 234 between the third aperture 194 and the upper ETM 214, wherein the upper ETM 214 is in communication with the lower ETM 212 via control lines 100. One or more of the upper and lower ETMs 214, 212 can be an inductive coupler segment 156, 108. One or more of the upper and lower ETMs 214, 212 is a wireless ETM (WETM) and the WETM is powered from an energy source selected from the group consisting of electricity, electromagnetism, magnetism, sound, motion, vibration, Piezoelectric crystals, motion of conductor/coil, ultrasound, incoherent light, coherent light, temperature, radiation, electromagnetic transmissions, and fluid pressure. A first tubing ETM 220 can be disposed along the first tubing string 30, and wherein the first tubing ETM 220 can be adjacent the upper ETM 214 of the unitary MIC junction assembly 200 when the first tubing string 30 is installed through the primary passageway 232 of the unitary MIC junction assembly 200.

The first tubing string 30 can be a tubing string 30 and the tubing string 30 extends through the primary passageway 232 of the unitary MIC junction assembly 200 and couples to a lower tubing string 78 that can be further downhole from the unitary MIC junction assembly 200. The lower portion of the primary passageway 232 can comprise a primary leg 148 of the unitary MIC junction assembly 200 and the lateral passageway 234 can comprise a lateral leg 150 of the unitary MIC junction assembly 200, and wherein one or more of the primary and lateral legs 148, 150 can be deformable. Laterals are typically drilled at an angle between about 2 degrees to about 5 degrees. Therefore, the deformable leg can be made to deform to a suitable angle to extend into the lateral (or twig, or branch) wellbore, with the suitable angle being between about 2 degrees to about 5 degrees. The suitable angle can also be between 0 degrees and 10 degrees.

A second tubing string 66*c* can include an end portion with a second tubing ETM 110 disposed on the end portion, where the second tubing string 66*c* can couple to the lateral leg 150 of the unitary MIC junction assembly 200 so that the second tubing ETM is adjacent to the lower ETM 212 of the unitary MIC junction assembly 200. The second tubing string 66*c* can be a lower completion assembly 66*c* and the second tubing ETM 110 can be a WETM. The lower completion assembly 66*c* comprises an operational device 102, wherein the operational device 102 is in communication with the second tubing ETM 110 via control lines 100, and wherein the operational device 102 is selected from the group consisting of sensors, flow control valves, controllers, WETMs, ETMs, contact electrical connectors, actuators, electrical power storage device, computer memory, and logic devices.

The operational device 102 can comprise first and second flow control valves 102, wherein the first flow control valve 102 can control fluid flow between a first wellbore interval 19*a-c* and a passageway 236 in the lower completion assembly 66*c*, and the second flow control valve 102 can control fluid flow between a second wellbore interval 19*a-c* and the passageway 236 in the lower completion assembly 66*c*. Signals from a remote location can be transmitted through the upper ETM 214 of the unitary MIC junction assembly 200, through the lower ETM 212 of the unitary MIC junction assembly 200, through the second tubing ETM 110, and to the first and second flow control valves 102, and wherein the signals can provide individual control, via the first and second flow control valves 102, of fluid flow between the respective first and second wellbore intervals 19*a-c* and the passageway 236 of the lower completion assembly 66*c*.

A lower completion assembly 66*c* with a passageway 236 that is in fluid communication with the lateral passageway 234 of the unitary MIC junction assembly 200. A flow control device 90 can be interconnected in the first tubing string 30, wherein the flow control device 90 is positioned within the primary passageway 232 of the unitary MIC junction assembly 200 when the first tubing string 30 in installed through the primary passageway 232. The flow control device 90 can control fluid flow between the lateral passageway 234 and a passageway 242 in the first tubing string 30.

A method for controlling fluid flow to/from multiple intervals 19*a-c* in a lateral wellbore 12*c* is provided, which can include operations installing a unitary multibranch inflow control (MIC) junction assembly 200 in a main wellbore 12*a* at an intersection 74 of a first lateral wellbore 12*c*.

The unitary MIC junction assembly 200 can comprise a conduit 206 with a first aperture 190 at an upper end 244 of the conduit 206, and second and third apertures 192, 194 at a lower end 246, 248 of the conduit 206; a primary passageway 232 formed by the conduit 206 and extending from the first aperture 190 to the second aperture 192 with a conduit junction 146 defined along the conduit 206 between the first and second apertures 190, 192, the primary passageway 232 comprising an upper portion and a lower portion with the upper portion extending from the first aperture 190 to the conduit junction 146, and the lower portion extending from the conduit junction 146 to the second aperture 192, with the lower portion comprising a primary leg 148; a lateral passageway 234 formed by the conduit 206 and extending from the conduit junction 146 to the third aperture 194, the lateral passageway 234 comprising a lateral leg 150; an upper energy transfer mechanism (ETM) 214 mounted along the upper portion of the primary passageway 232 and proximate the first aperture 190; and control lines 100 that provide communication between the upper ETM 214 and lower completion assembly 66*c*, 66*d* equipment (48, 102, 99*a-g*, etc.).

The operations can also include coupling the lateral leg 150 with a lower completion assembly 66*c*; installing a first tubing string 30 in the main wellbore 12*a*; and extending the first tubing string 30 through the primary passageway 232 of the unitary MIC junction assembly 200 or multiple primary passageways 232 of multiple unitary MIC junction assemblies 200.

For any of the foregoing embodiments, the method may include any one of the following elements, alone or in combination with each other:

The operations can also include coupling the lateral leg 150 with the lower completion assembly 66*c* prior to the installing of the unitary MIC junction assembly 200, wherein the installing of the unitary MIC junction assembly 200 further comprises installing the lower completion assembly 66*c* in the lateral wellbore 12*c* as the unitary MIC junction assembly 200 is being installed. In this configuration, the lower ETM 212 may not be required, since the control line connections can be made at the surface during assembly of the lower completion assembly 66*c* to the lateral leg 150 of the unitary MIC junction assembly 200. However, the lower ETM 212 can be utilized with it mounted along the lateral passageway 234 between the third aperture 194 and the upper ETM 214, wherein the upper ETM 214 is in communication with the lower ETM 212 via control lines 100

The operations can also include coupling the lateral leg 150 with the lower completion assembly 66*c* while the unitary MIC junction assembly 200 is being installed at the intersection 74.

The operations can also include aligning a first tubing ETM 220 with the upper ETM 214 in the unitary MIC junction assembly 200, and controlling multiple operational devices 102 in the lower completion assembly 66*c* via control and data signals transmitted between the first tubing ETM 220 and the upper ETM 214. The operational devices 102 can be selected from the group consisting of sensors, flow control valves, controllers, WETMs, ETMs, contact electrical connectors, actuators, electrical power storage device, computer memory, and logic devices. The lateral wellbore intersects multiple formation intervals 19*a-c* in the earthen formation 14, and the controlling can include controlling fluid flow between each of the formation intervals and a passageway in the lower completion assembly 66*c*.

The operations can also include installing a second tubing string 78 in the main wellbore 12*a* below the unitary MIC junction assembly 200 prior to the installing of the unitary MIC junction assembly 200, wherein the extending the first tubing string 30 further comprises coupling a distal end of the first tubing string 30 to a proximal end of the second tubing string 78, where another ETM, similar to ETM 220, can be used to provide communication between the first tubing string 30 and the second tubing string 78.

A method for controlling fluid flow to/from multiple intervals (at least 19*a-c*) in lateral wellbores 12*c*, 12*d* is provided, which can include operations of installing first and second unitary multibranch inflow control (MIC) junction assemblies 200*b*, 200*a* in a main wellbore 12*a*. The first unitary MIC junction assembly 200*a* can be installed at a first intersection 74 of a first lateral wellbore 12*c* prior to installing the second unitary MIC junction assembly 200*b* at a second intersection 84 of a second lateral wellbore 12*d*. Each of the first and second unitary MIC junction assemblies 200*b*, 200*a* can include: a conduit 206 with a first aperture 190 at an upper end 244 of the conduit 206, and second and third apertures 192, 194 at a lower end 246, 248 of the conduit 206; a primary passageway 232 formed by the conduit 206 and extending from the first aperture 190 to the second aperture 192 with a conduit junction 146 defined along the conduit 206 between the first and second apertures 190, 192, the primary passageway 232 can include an upper portion and a lower portion with the upper portion extending from the first aperture 190 to the conduit junction 146, and the lower portion extending from the conduit junction 146 to the second aperture 192, with the lower portion comprising a primary leg 148; a lateral passageway 234 formed by the conduit 206 and extending from the conduit junction 146 to the third aperture 194, where the lateral passageway 234 can include a lateral leg 150; an upper energy transfer mechanism (ETM) 214 mounted along the upper portion of the primary passageway 232 and proximate the first aperture 190; and control lines 100 that can provide communication between the upper ETM and first lower completion assembly equipment.

The method can further include operations of coupling the lateral leg of the first unitary MIC junction assembly with a first lower completion assembly, coupling the lateral leg of the second unitary MIC junction assembly with a second lower completion assembly, installing a first tubing string in the main wellbore, and extending the first tubing string through the primary passageways of the first and second unitary MIC junction assemblies.

Furthermore, the illustrative methods described herein may be implemented by a system comprising processing circuitry that can include a non-transitory computer readable medium comprising instructions which, when executed by at least one processor of the processing circuitry, causes the processor to perform any of the methods described herein.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

The invention claimed is:

1. A multilateral wellbore system comprising:

a unitary multibranch inflow control (MIC) junction assembly disposed within a first intersection in a wellbore, the first intersection defined between a main wellbore and a first lateral wellbore, the unitary MIC junction assembly having a conduit with a first aperture at an upper end of the conduit, and second and third apertures at a lower end of the conduit;

a primary passageway formed by the conduit and extending from the first aperture to the second aperture with a conduit junction defined along the conduit between the first and second apertures, the primary passageway comprising an upper portion and a lower portion with the upper portion extending from the first aperture to the conduit junction, and the lower portion extending from the conduit junction to the second aperture;

a lateral passageway formed by the conduit and extending from the conduit junction to the third aperture;

an upper wireless energy transfer mechanism (WETM) mounted along the upper portion of the primary passageway and proximate the first aperture;

control lines that provide communication between the upper WETM and lower completion assembly equipment fluidly coupled to either the primary passageway or the lateral passageway;

a first tubing string received into the primary passageway such that the first tubing string extends therethrough to a second intersection in the wellbore, the second intersection defined between the main wellbore and a second lateral wellbore;

a first tubing WETM disposed along the first tubing string, the first tubing WETM axially aligned with the upper WETM of the unitary MIC junction assembly; and wherein the lower completion assembly equipment comprises at least one flow control device interconnected in the first tubing string below the unitary MIC junction assembly and above the second intersection in the wellbore, the at least one flow control device operable to control an amount of fluid received into the first tubing string from the main wellbore below the second intersection and the second lateral wellbore.

2. The system of claim 1, further comprising a lower energy transfer mechanism (ETM) mounted along the lateral passageway between the third aperture and the upper WETM, wherein the upper WETM is in communication with the lower ETM via the control lines.

3. The system of claim 2, wherein the lower ETM is a wireless ETM (WETM) and wherein at least one of the upper and lower ETMs is powered from an energy source selected from the group consisting of electricity, electromagnetism, magnetism, sound, motion, vibration, Piezoelectric crystals, motion of conductor/coil, ultrasound, incoherent light, coherent light, temperature, radiation, electromagnetic transmissions, and fluid pressure.

4. The system of claim 1, wherein the lower portion of the primary passageway comprises a primary leg of the unitary MIC junction assembly and the lateral passageway comprises a lateral leg of the unitary MIC junction assembly, and wherein at least one of the primary and lateral legs is deformable.

5. The system of claim 4, further comprising a second tubing string having an end portion with a second tubing WETM disposed on the end portion, wherein the second tubing string couples to the lateral leg of the unitary MIC junction assembly so that the second tubing ETM is axially aligned with the lower WETM of the unitary MIC junction assembly.

6. The system of claim 5, wherein the second tubing string is a lower completion assembly.

7. The system of claim 6, wherein the lower completion assembly comprises an operational device, wherein the operational device is in communication with the second tubing ETM via control lines, and wherein the operational device is selected from the group consisting of electrical, optical, hydraulic, and fluidic versions of a sensor, a flow control valve, a controller, a WETMs, an ETMs, a connector, an actuator, a power storage device, a computer memory, and a logic device.

8. The system of claim 7, wherein the operational device comprises first and second flow control valves, wherein the first flow control valve controls fluid flow between a first wellbore interval and a passageway in the lower completion assembly, and the second flow control valve controls fluid flow between a second wellbore interval and the passageway in the lower completion assembly.

9. The system of claim 8, wherein communication signals from a remote location are transmitted through the upper WETM of the unitary MIC junction assembly, through the lower WETM of the unitary MIC junction assembly, through the second tubing WETM, and to the first and second flow control valves, and wherein the communication signals provide individual control, via the first and second flow control valves, of fluid flow between the respective first and second wellbore intervals and the passageway of the lower completion assembly.

10. The system of claim 8, wherein communication signals from a sensor in the lower completion assembly are transmitted through the second tubing WETM, through the lower WETM of the unitary MIC junction assembly, through the upper WETM of the unitary MIC junction assembly, and to a remote location, and wherein the communication signals provide indications of conditions and/or configurations in the lower completion assembly, and the first and second flow control valves are controlled in response to the communication signals being received at the remote location.

11. The system of claim 1, further comprising a lower completion assembly with a passageway that is in fluid communication with the lateral passageway of the unitary MIC junction assembly.

12. The system of claim 11, further comprising a flow control device interconnected in the first tubing string, wherein the flow control device is positioned within the primary passageway of the unitary MIC junction assembly when the first tubing string is installed through the primary passageway, and wherein the flow control device controls fluid flow between the lateral passageway and a passageway in the first tubing string.

13. The system of claim 1, wherein the at least one flow control device includes a first flow control device through which fluid from the main wellbore below the second intersection may flow from an interior of the first tubing string into an annulus around the first tubing string and a second flow control device through which the fluid may reenter the first tubing string from the annulus.

14. The system of claim 1, further comprising a telescoping joint at a distal end of the lateral passageway.

15. A method of controlling fluid flow to/from multiple intervals in a lateral wellbore, the method comprising:

installing a unitary multibranch inflow control (MIC) junction assembly in a main wellbore at a first intersection defined between the main wellbore and a first lateral wellbore, the unitary MIC junction assembly comprising:

a conduit with a first aperture at an upper end of the conduit, and second and third apertures at a lower end of the conduit;

a primary passageway formed by the conduit and extending from the first aperture to the second aperture with a conduit junction defined along the conduit between the first and second apertures, the primary passageway comprising an upper portion and a lower portion with the upper portion extending from the first aperture to the conduit junction, and the lower portion extending from the conduit junction to the second aperture, with the lower portion comprising a primary leg;

a lateral passageway formed by the conduit and extending from the conduit junction to the third aperture, the lateral passageway comprising a lateral leg;

an upper wireless energy transfer mechanism WETM mounted along the upper portion of the primary passageway and proximate the first aperture; and control lines that provide communication between the upper WETM and lower completion assembly equipment;

coupling the lateral leg with a lower completion assembly;

installing a first tubing string in the main wellbore; and extending the first tubing string through the primary passageway of the unitary MIC junction assembly to a second intersection in the wellbore, the second intersection defined between the main wellbore and a second lateral wellbore to thereby axially align a first tubing WETM disposed along the first tubing string with the upper WETM of the unitary MIC junction assembly; and controlling an amount of fluid received into the first tubing string from the main wellbore and the second lateral wellbore below the second intersection with the lower completion assembly equipment.

16. The method of claim 15, wherein the coupling further comprises coupling the lateral leg with the lower completion assembly prior to the installing of the unitary MIC junction assembly, wherein the installing of the unitary MIC junction assembly further comprises installing the lower completion assembly in the lateral wellbore as the unitary MIC junction assembly is being installed.

17. The method of claim 15, wherein the coupling further comprises coupling the lateral leg with the lower completion assembly while the unitary MIC junction assembly is being installed at the intersection.

18. The method of claim 15, wherein the installing the first tubing string further comprises axially aligning the first tubing WETM with the upper WETM in the unitary MIC junction assembly such that the first tubing WETM is generally concentric with the upper WETM in the unitary MIC junction assembly.

19. The method of claim 18, further comprising controlling and/or monitoring multiple operational devices in the lower completion assembly via communication signals transmitted between the first tubing WETM and the upper WETM.

20. The method of claim 19, wherein the operational devices are selected from the group consisting of electrical, optical, hydraulic, and fluidic versions of a sensor, a flow control valve, a controller, a WETM, an ETM, a connector, an actuator, a power storage device, a computer memory, and a logic device.

21. The method of claim 19, wherein the lateral wellbore intersects a plurality of formation intervals in an earthen formation, and wherein the controlling further comprises controlling fluid flow between each of the formation intervals and a passageway in the lower completion assembly.

22. The method of claim 15, further comprising installing a second tubing string in the main wellbore below the unitary MIC junction assembly prior to the installing of the unitary MIC junction assembly, wherein the extending the first tubing string further comprises coupling a distal end of the first tubing string to a proximal end of the second tubing string.

23. A method of controlling fluid flow to/from multiple intervals in multiple lateral wellbores, the method comprising:

installing first and second unitary multibranch inflow control (MIC) junction assemblies in a main wellbore, wherein the first unitary MIC junction assembly is installed at a first intersection of a first lateral wellbore prior to installing the second unitary MIC junction assembly at a second intersection of a second lateral wellbore, and wherein the first and second unitary MIC junction assemblies each comprise:

a conduit with a first aperture at an upper end of the conduit, and second and third apertures at a lower end of the conduit;

a primary passageway formed by the conduit and extending from the first aperture to the second aperture with a conduit junction defined along the conduit between the first and second apertures, the primary passageway comprising an upper portion and a lower portion with the upper portion extending from the first aperture to the conduit junction, and the lower portion extending from the conduit junction to the second aperture, with the lower portion comprising a primary leg;

a lateral passageway formed by the conduit and extending from the conduit junction to the third aperture, the lateral passageway comprising a lateral leg;

an upper wireless energy transfer mechanism WETM mounted along the upper portion of the primary passageway and proximate the first aperture; and control lines that provide communication between the upper WETM and first lower completion assembly equipment comprising at least one flow control device;

coupling the lateral leg of the first unitary MIC junction assembly with a first lower completion assembly;

coupling the lateral leg of the second unitary MIC junction assembly with a second lower completion assembly;

installing a first tubing string in the main wellbore;

extending the first tubing string through the primary passageways of the first and second unitary MIC junction assemblies to a third intersection of a third lateral wellbore below the first and second intersections to thereby axially align first and second tubing WETMs disposed along the first tubing string with the upper wireless WETM of each of the first and second the unitary MIC junction assemblies; and controlling an amount of fluid received into the first tubing string from the main wellbore and the third lateral wellbore below the third intersection with the at least one flow control device interconnected in the first tubing string between the second and third intersections.

* * * * *